US006287183B1

(12) United States Patent
Zhang et al.

(10) Patent No.: US 6,287,183 B1
(45) Date of Patent: Sep. 11, 2001

(54) VACUUM-HYDROSTATIC SHOE FOR CENTERLESS GRINDING

(75) Inventors: Bi Zhang; Yanhua Yang, both of Storrs, CT (US)

(73) Assignee: The University of Connecticut, Farmington, CT (US)

( * ) Notice: Subject to any disclaimer, the term of this patent is extended or adjusted under 35 U.S.C. 154(b) by 0 days.

(21) Appl. No.: 09/466,256

(22) Filed: Dec. 17, 1999

Related U.S. Application Data

(60) Provisional application No. 60/112,728, filed on Dec. 18, 1998.

(51) Int. Cl.[7] ..... B24B 5/18

(52) U.S. Cl. ..... 451/407; 451/5; 451/402; 451/388; 451/142; 451/242; 384/116

(58) Field of Search ..... 451/407, 402, 451/388, 241, 242, 449, 49, 142; 269/21; 354/116, 107–120

(56) References Cited

U.S. PATENT DOCUMENTS 2,059,895 * 11/1936 Norton et al. ..... 451/407
3,466,810 * 9/1969 Schaller ..... 451/407
3,594,955 * 7/1971 Collin ..... 451/407
5,108,177 * 4/1992 Crossman et al. ..... 279/126
5,558,567 * 9/1996 Hedberg ..... 451/242

* cited by examiner

*Primary Examiner*—Joseph J. Hail, III
*Assistant Examiner*—George Nguyen
(74) *Attorney, Agent, or Firm*—Alix, Yale & Ristas, LLP

(57) ABSTRACT

A vacuum-hydrostatic shoe especially suited for supporting a workpiece in metalworking operations is disclosed. The vacuum-hydrostatic shoe is comprised of a body with a support surface confronting the workpiece. Preferably the support surface is shaped to substantially conform to the workpiece shape. The shoe body comprises hydrostatic pockets. Each hydrostatic pocket has a first pressure opening defined in the support surface and a second pressure opening fluidly connected to a respective first pressure opening. The second pressure openings are also fluidly connected to a supply of pressurized fluid so that a flow of pressurized fluid can be created between the shoe body and the workpiece. The shoe body further comprises a vacuum pocket. The vacuum pocket has a first vacuum opening defined in the support surface and a fluidly connected second vacuum opening. The second vacuum opening is also fluidly connected to a source of vacuum to create a vacuum pressure between the shoe body and workpiece. The vacuum-hydrostatic shoe creates a hydrostatic pressure to provide a non-contact support to the workpiece and a vacuum pressure to preload and stabilize the workpiece.

10 Claims, 26 Drawing Sheets

VACUUM-HYDROSTATIC SHOE FOR CENTERLESS GRINDING

CROSS-REFERENCE TO RELATED APPLICATIONS

This application claims the benefit of U.S. Provisional Application No. 60/112,728 filed Dec. 18, 1998.

BACKGROUND OF THE INVENTION

This invention relates generally to an apparatus for holding a workpiece. More particularly, this invention relates to a device for holding a rotatable workpiece during metalworking operations such as centerless grinding.

Grinding is one of the most effective machining methods to finish a workpiece for good dimensional accuracy and surface quality. Among the large family of grinding processes, centerless grinding is widely used to machine circular workpieces, such as the bearing rings, shafts, and rollers. The merits of the centerless grinding process include efficiency in loading and unloading workpieces and maintenance of desired geometric accuracy. Since centerless grinding is effective in terms of cost and precision, it has been widely used in manufacturing industries for many decades, especially in the anti-friction bearing industry.

Anti-friction bearings are among the most important mechanical elements used in modern industry. The application of bearings is so widespread that one may find them in almost every device; ranging from military weapons to medical equipment, machine tools, aerospace devices, and even children's toys. The widespread use of bearings has made bearing manufacturing one of the most important industries in the world.

One particular centerless grinding process, shoe centerless grinding, has been used throughout the bearing industry for machining workpieces such as bearing components. In this grinding process, a workpiece is driven by a magnetic drivehead, supported by a front and rear shoes, and machined by a grinding wheel, as illustrated in FIG. 1. The magnetic drivehead rotates at a prescribed rotational speed and drives the workpiece to rotate at a certain speed through the planar frictional contact between the drivehead and the workpiece. The magnetic intensity determines the normal force of the contact surfaces while an offset identifies the relative sliding velocity between the workpiece and the drivehead. Two shoes are used to support and locate the workpiece. The grinding wheel moves towards the workpiece to remove material from the workpiece and the circularity of the workpiece is uniquely determined by three contact points with the workpiece, the two shoes and the grinding wheel. A typical shoe centerless grinding is characterized by setup parameters such as two setup angles $\alpha$ and $\beta$, and the offset $\delta$ of the workpiece center with respect to the drivehead center; and by process parameters, such as drivehead magnetic intensity, the rotational speeds of the drivehead, workpiece and grinding wheel and the infeed rate of the grinding wheel.

Shoe centerless grinding also functions to attenuate the existing irregularities on the workpiece surface thereby increasing surface quality and dimensional accuracy. Since the workpiece is located and supported by two shoes, any variation in workpiece diameter can cause the workpiece center to move. The nature of the floating center of the workpiece distinguishes this process from center type grinding processes.

Out-of-roundness error of the workpiece has been a major concern in applying centerless grinding. The error usually results from the variation of the offset $\delta$ which is caused by two sources: workpiece dimensional change due to material removal and workpiece surface irregularities. When a surface irregularity is in contact with a support shoe, it forces the workpiece center to move away from the shoe surface by an amount equal to the height of the irregularity, thus causing a variation in the center offset $\delta$. The variation in center offset will change the desired interacting position between the grinding wheel and the workpiece and therefore add a new irregularity to the workpiece surface. Geometrically and dynamically, when the irregularity passes over a support shoe, an undesirable perturbation is generated to the workpiece. If the amplitude of the perturbation is increased in the subsequent processes, the grinding system is considered to be geometrically and dynamically unstable, otherwise, it is considered to be stable. A stable grinding system is always preferred for achieving a workpiece with a good roundness and surface finish. However, a grinding system may become unstable due to the geometric, dynamic and workholding instability problems.

Geometric instability is mainly caused by the geometric setup of the grinding system. Workholding instability is induced by rotational variations of the workpiece, bounce of the workpiece from a support shoe, or the workpiece rotational speed matching that of the grinding wheel. Dynamic instability results from self-excited vibrations of the system. The workpiece perturbation induced by the grinding system may serve as a cause to initiate a self-excited vibration.

The above three instability problems have been recognized as critical problems to improvement of workpiece roundness in shoe centerless grinding processes for over a half century. However, these problems have not yet been satisfactorily solved.

In the shoe centerless grinding process, the magnetic drivehead provides a torque to the workpiece through offsetting the workpiece center with respect to the drivehead. The torque may be decomposed into a spin torque and a global torque. The global torque tends to drive the workpiece to rotate around the rotational center of the drivehead. However, the global torque cannot drive the workpiece to rotate around the rotational center of the drivehead because such a rotational motion would be stopped by the shoes, causing the workpiece to slip against the drivehead, and thus generating a driving force through friction that attempts to drive the workpiece to revolve about the drivehead. A spin torque is a driving torque that drives the workpiece to rotate around its own center through friction. Therefore, the workpiece is subjected to the driving force and the driving torque. Due to the nature of its constraints, the workpiece has three degrees of freedom and can only be allowed to have planar movement. To achieve workholding stability, two constraints are required to eliminate the two translational degrees of freedom; and the spin torque must be balanced to stabilize workpiece rotation. All the constraints to the workpiece, whether translational or rotational, can be varied in strength by varying the process parameters. Of these process parameters, the rotational speed of the drivehead, the magnetic intensity of the drivehead and the offset play important roles in workholding through which, the driving force and the driving torque regulate the workpiece movement. The relative motion of the workpiece with respect to the drivehead is a kinematic behavior of the workholding mechanisms. In order to obtain a stable workholding, the relative movement of the workpiece against the drivehead must be analyzed, the driving force and driving torque must be derived in terms of the process parameters, and workholding stability conditions need to be established.

In center-type grinding where a workpiece is securely held by workpiece centers, there is no workholding stability problem. However, in shoe centerless grinding, the workpiece is maintained in its nested position by the resulting system of forces provided by the shoes, drivehead, and grinding wheel. If the workpiece is maintained under a stable equilibrium condition, it is considered to be a case of stable workholding, otherwise, the following unstable workholding cases may occur.

a. The workpiece stops rotating but remains supported by the shoes;

b. The workpiece loses contact with one or both shoes;

c. The grinding force becomes the controlling force in the workpiece rotation, which tends to drive the workpiece to rotate at the same peripheral speed as the grinding wheel;

d. The workpiece vibrates too violently to rotate under a normal grinding condition.

There have been no publicized reports dealing with the workholding stability and workholding mechanism in terms of grinding system kinematics and mechanics, although both of the issues are important and fundamental. In essence, the nature of workholding is determined by the driving capability and the constraining capability of a shoe centerless grinding system. The driving capability is featured by a driving force and a driving torque applied by the drivehead which is related to the rotational speed and magnetic intensity of the drivehead, the friction coefficient, the contact area and offset of the workpiece with respect to the drivehead. The constraining capability is evaluated by the reacting forces at two shoes and the grinding wheel which are determined by the shoe setup angles, the grinding conditions, and the friction coefficients between the workpiece and the shoes. An unstable workholding can result when the driving capability provided by a drivehead to a workpiece is saturated or the constraining capability of the centerless grinding process is not properly selected.

SUMMARY OF THE INVENTION

An object of the invention is to provide a new and improved device for holding a workpiece during metalworking operations.

Another object of the invention is to provide a vacuum-hydrostatic shoe for supporting a workpiece during metalworking operations.

A further object of the invention is to provide a non-contact vacuum-hydrostatic shoe for supporting a workpiece during a shoe centerless grinding operation.

A yet further object of the invention is to provide a non-contact vacuum-hydrostatic shoe for a centerless grinder which can improve workpiece quality and dimensional accuracy.

Briefly stated, the invention in a preferred form is a vacuum-hydrostatic shoe especially applicable to centerless grinding. The shoe has a body or shoe pad with a support surface for confronting a workpiece surface. The support surface defines a plurality of hydrostatic pockets. Each hydrostatic pocket is fluidly connected a source of pressurized fluid so that a fluid film is created between the support surface and the workpiece surface. The fluid film imposes a force on the workpiece which tends to move the workpiece surface away from the support surface. The support surface further defines a vacuum pocket fluidly connected to a source of vacuum, so that a vacuum is created between the shoe pad and the workpiece surface. The vacuum imposes an attractive force on the workpiece which tends to move the workpiece surface toward the support surface. Thus the vacuum-hydrostatic shoe uses a hydrostatic bearing to provide a non-contact support to the workpiece and a vacuum pressure to preload and stabilize the workpiece. The vacuum-hydrostatic shoe is preferably curved to conform to the typically circular shaped workpiece used in centerless grinding.

BRIEF DESCRIPTION OF THE DRAWINGS

Other objects and advantages of the invention will be evident to one of ordinary skill in the art from the following detailed description, made with reference to the accompanying drawings, in which.

DETAILED DESCRIPTION OF THE PREFERRED EMBODIMENTS

Figure 4:
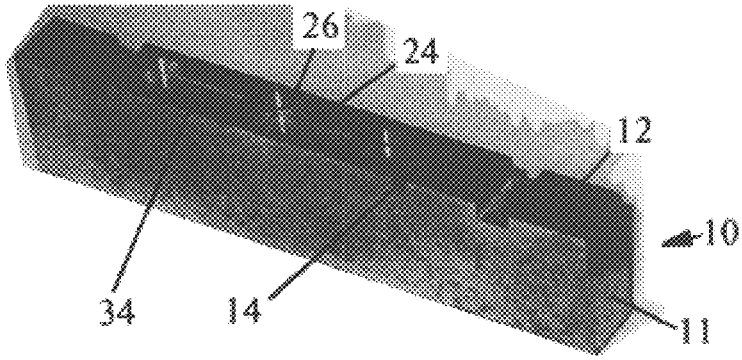
FIG. 4 is a perspective view of an inventive flat vacuum-hydrostatic shoe.
Figure 6:
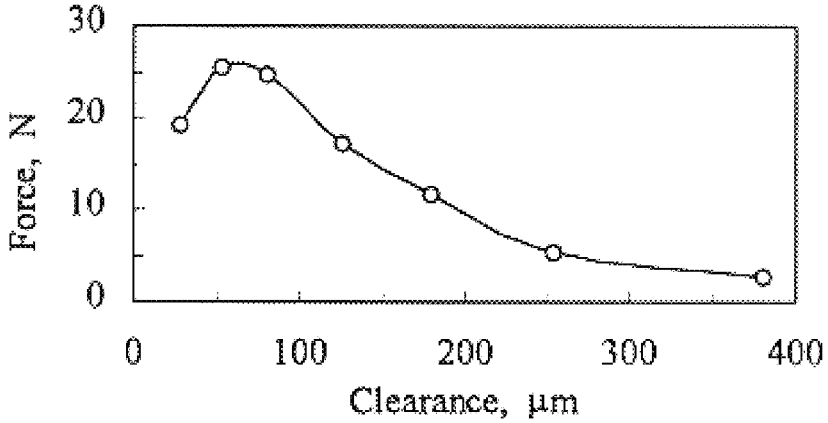
FIG. 6 is a graph of vacuum retaining force versus working clearance for a vacuum-hydrostatic shoe.

With reference to the drawings, wherein like numerals represent like parts throughout the figures, a flat vacuum-hydrostatic shoe is generally designated 10. As shown in FIG. 4, the flat vacuum-hydrostatic shoe comprises a shoe pad 11 with a support surface 12. A first fluid or hydrostatic pocket 14 is contained within the shoe. The hydrostatic pocket 14 has a first pressure opening 16 defined in the support surface 12 and a second pressure opening (18 but not shown in FIG. 4) fluidly connected to the first pressure opening 16. The second pressure opening 18 is fluidly connected to a supply of pressurized fluid 20 (see FIGS. 6 and 24) for flow through the first pressure opening 16.

A vacuum pocket 24 is contained within the shoe pad 11. The 25 vacuum pocket 24 has a first vacuum opening 26 defined in the support surface 12 and a second vacuum opening (28 but not shown in FIG. 4) fluidly connected to the first vacuum opening 26. The second vacuum opening 28 is fluidly connected to a source of vacuum 30 (see FIGS. 6 and 24) to create a vacuum at the first vacuum opening 26.

Preferably as shown in FIG. 4, the shoe 10 includes a second hydrostatic pocket 34, with each hydrostatic pocket 14, 34 located adjacent an opposing end of the shoe support surface 1 2. The vacuum pocket 24 is preferably located intermediate the hydrostatic pockets 14, 34. The second hydrostatic pocket 34 has a first pressure opening 33 defined in the support surface 12 and a second pressure opening 35 fluidly connected to the first pressure opening 33. The second pressure opening 35 is fluidly connected to a supply of pressurized fluid 20 for flow through the first pressure opening 33.

Mathematic modeling of the vacuum-hydrostatic shoe was conducted. The calculations used may be found in a dissertation titled "Design of a Vacuum-Hydrostatic Shoe for Centerless Grinding" submitted by Yanhua Yang to the University of Connecticut in 1998, which dissertation is incorporated by reference herein. The above dissertation is cataloged in, and available from, the University of Connecticut library at Storrs, Conn. 06268. The above dissertation is also commercially available from Bell & Howell Information and Learning (formerly known as UMI), 300 North Zeeb Road, P.O. Box 1346, Ann Arbor, Me. 48106-1346, U.S.A.

Figure 2:
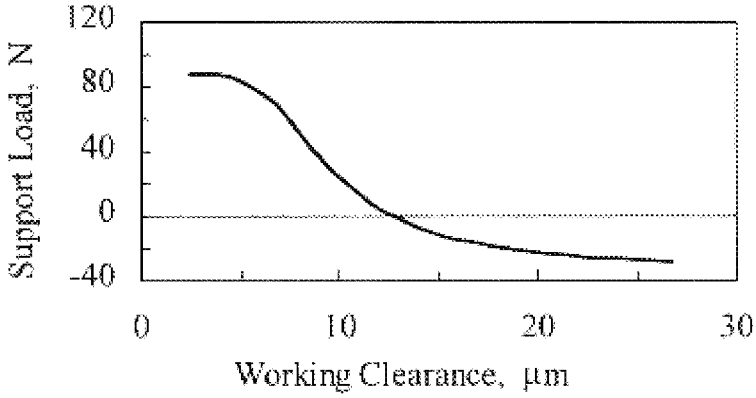
FIG. 2 is a graph of load carrying capability versus working clearance for an inventive vacuum-hydrostatic shoe.
Figure 3:
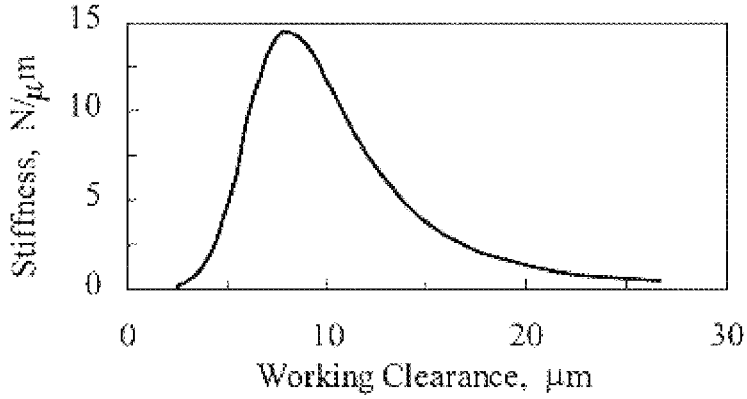
FIG. 3 is a graph of stiffness versus working clearance for a flat vacuum-hydrostatic shoe.

Correlations of vacuum-hydrostatic shoe load carrying capacity and stiffness with the working clearance were simulated, and the results are presented in FIGS. 2 and 3, where the pocket configurations are shown in FIG. 4. The simulation was based on a compensated supply pressure of 30 psi (0.2 MPa) and a design resistance ratio of 2.72 at a design clearance of 500 $\mu$m (12.5 $\mu$m). The pocket dimensions are generally designed according to the workpiece dimensions. The design provides a vacuum retaining force to balance the hydraulic support force so that the workpiece could be maintained at a design clearance with respect to the support surface 12. If the workpiece is loaded as will occur during the grinding process, a decrease of the working clearance will induce an additional support force to balance the workpiece load. On the other hand, a vacuum retaining force is generated to hold the workpiece back if any disturbance attempts to pull the workpiece away from its equilibrium position. Stiffness is a measure of the change in film thickness between support surface 12 and workpiece with a change in workpiece load. The stiffness of the vacuum-hydrostatic shoe 10 increases with the decrease of the working clearance in a certain range and maximum stiffness can be arranged at a desired working clearance through appropriate selection of design parameters.

EXAMPLE 1

The arrangement shown in FIG. 4 for an inventive shoe 10 with two hydrostatic pockets 14, 34 at the ends and a vacuum pocket 24 in the middle of the shoe pad 11 was used. This arrangement aims to minimize vacuum leakage and provide the shoe 10 with self-compensation effect through outflow resistances at the shoe ends. The outflow resistances are a result of the limited clearance between the support surface 12 and workpiece.

Figure 5:
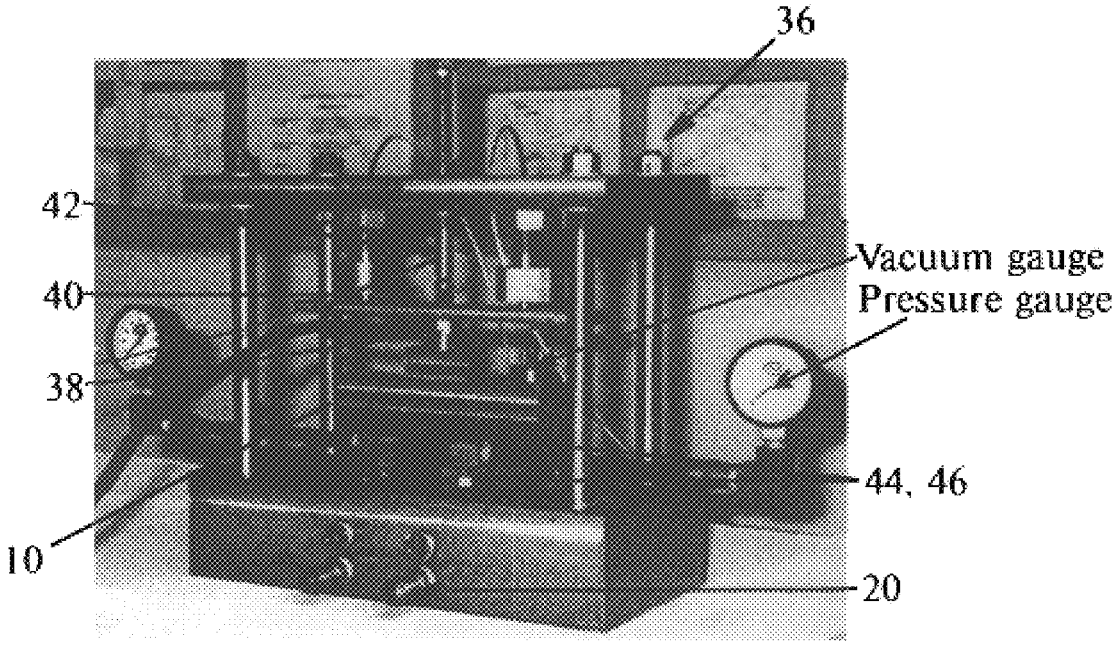
FIG. 5 is a perspective view of a test apparatus for a flat vacuum-hydrostatic shoe.

As shown in FIG. 5 the vacuum-hydrostatic shoe 10 was attached to a hydraulic control unit 36 capable of adjusting the inflow resistance of the two hydrostatic pockets 14, 34, the flow rate of the fluid, providing pressurized fluid and vacuum to the shoe pockets, 14, 24, 34 and serving as a base to setup capacitance sensors 40 and force transducers 38 as well as piezoelectric actuators 42.

The flat shoe 10 rested on top of the hydraulic unit 36 with a flat plate placed on the flat shoe 10 to simulate a workpiece. Four columns were used to connect a top plate to the hydraulic unit 36 and provided a stiffness of about 50 N/$\mu$m. Coolant as the bearing fluid was supplied from the two fluid inlets 20 in front of the hydraulic unit 36 and vacuum was generated from the back of the unit. The coolant used was a water based metalworking fluid. Both hydraulic pressure and vacuum level were monitored through pressure and vacuum gauges. The inflow resistance between the fluid supply 20 and the hydrostatic pockets 14, 34 could be adjusted by the two needle valves 44, 46 which acted as orifice type inflow restrictors. The working clearance between the vacuum-hydrostatic shoe 10 and the flat plate was detected by two capacitance sensors 40 with a working range of 50 $\mu$m and resolution of 50 nm. The external load acting on the vacuum-hydrostatic shoe 10 was measured by a Kistler force transducer 38 sandwiched between the top plate and the flat plate. A piezoelectric actuator 42 was used to load the vacuum-hydrostatic shoe in certain waveforms, such as impulse, step and multi-step, and sinusoidal inputs. By detecting the force and displacement signals of the flat plate, the load capacity and the stiffness of the vacuum-hydrostatic shoe 10 were evaluated with respect to working clearance under various design and working conditions.

The vacuum retaining force generated by vacuum pocket 24 serves as a preload to the vacuum-hydrostatic shoe 10.

The magnitude of the vacuum retaining force affects the load capacity and the stiffness of the vacuum-hydrostatic shoe. As given in FIG. 6, the correlation of the vacuum retaining force with shoe working clearance is presented. The vacuum retaining force had a non-linear relationship with the working clearance. The maximum value appeared at a certain working clearance where the combined effect of vacuum level and effective vacuum pocket area reached a maximum. Due to leakage from the clearance between the shoe and workpiece to the vacuum pocket 24, the measured vacuum retaining force was smaller than the ideal force of 32.7 N.

Figure 7A:
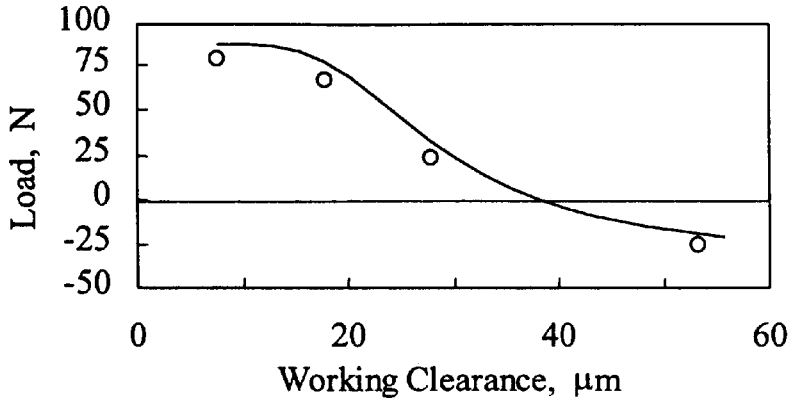
FIG. 7*a* is a graphical comparison between simulation (solid line) and experimental (dots) results of load capacity versus working clearance for a vacuum-hydrostatic shoe.
Figure 7B:
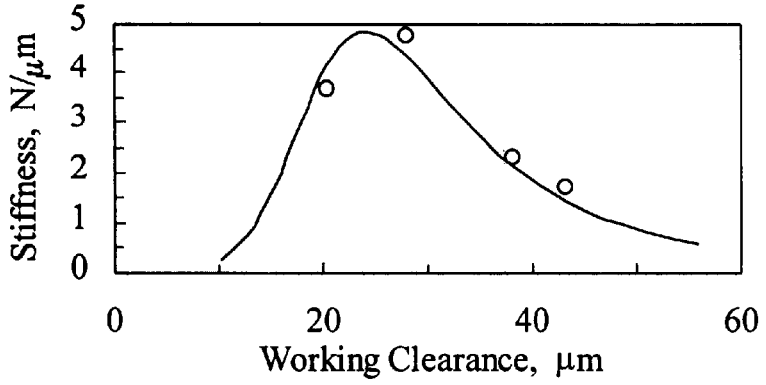
FIG. 7*b* is a graphical comparison between simulation (solid line) and experimental (dots) results of stiffness versus working clearance for a vacuum-hydrostatic shoe.

Experiments were carried out to obtain a correlation between the external load and the vacuum-hydrostatic shoe/workpiece clearance at various fluid supply pressures, inflow resistances, and design clearances for the vacuum-hydrostatic shoe. In the experiments, step or multi-step loading was generated by the piezoelectric actuator 42. The external load was measured by the piezoelectric force transducer 38, while working clearance was the average value from the two capacitance sensors 40. The results shown in FIGS. 7*a* and 7*b* were obtained under the following conditions: design clearance of the shoe 0.0015 in (37.5 $\mu$m), fluid supply pressure 37.5 psi (0.26 MPa) and resistance ratio 2.72 at the design clearance.

Figure 8:
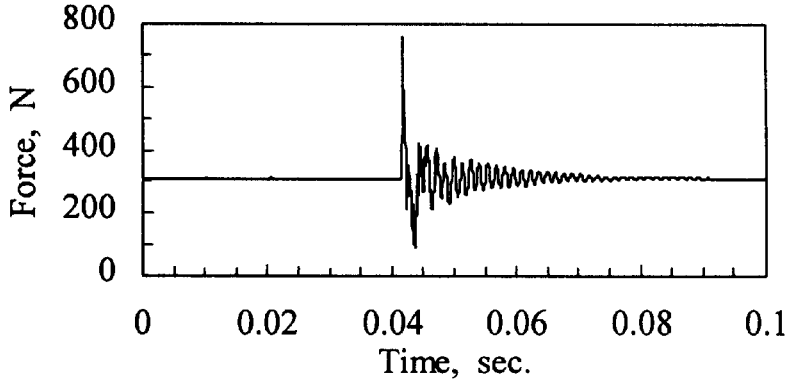
FIG. 8 is a graph of an impulse input force applied to a vacuum-hydrostatic shoe.
Figure 9:
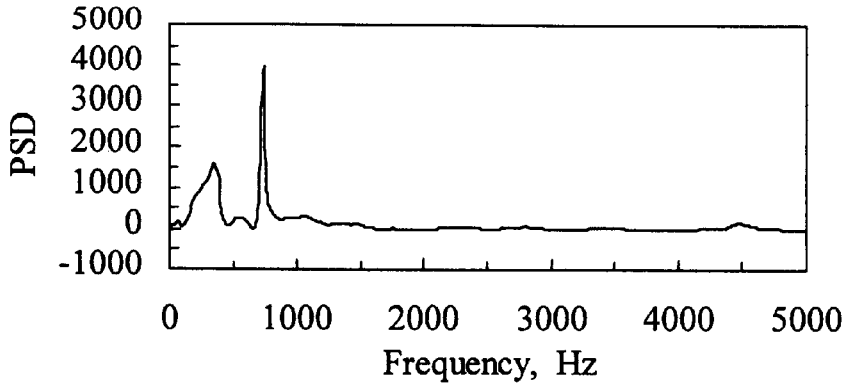
FIG. 9 is a graph of the Power Spectrum Density of a vacuum-hydrostatic shoe associated with the input shown in FIG. 8.

The stiffness of the vacuum-hydrostatic shoe 10 was also be verified by examining the dynamic behavior of the shoe 10 under impulse input. FIG. 8 shows an impulse input to the shoe 10 and FIG. 9 shows the associated output Power Spectrum Density of the shoe 10 excited by the piezoelectric actuator 42. The shoe was under a design clearance of 12.5 $\mu$m, fluid supply pressure of 0.26 MPa, and resistance ratio of 2.72 at the design clearance. The calculated stiffness under the above conditions was 10 N/$\mu$m. Additionally, the moving mass of the simulated workpiece was 1.365 kg, which included the flat plate, the force transducer, and the preload unit of the force transducer. Thus, the natural frequency of the vacuum-hydrostatic shoe was calculated to be 431 Hz. Since the piezoelectric actuator was placed between the shoe and the top plate of the hydraulic block, two frequencies should be identified from the impulse response. The hydraulic block had a calculated primary natural frequency of about 750 Hz.

As measured, there were two natural frequencies of 413 Hz and 738 Hz, one for the vacuum-hydrostatic shoe 10 and the other for the hydraulic block. The simulation results on the natural frequencies showed good agreement with the calculated results.

Since the vacuum-hydrostatic shoe combines vacuum with a hydrostatic bearing, it is not surprising that fluid enters the vacuum pocket 24, which can decrease vacuum level. To solve this problem, the fluid drawn from the vacuum pocket 24 must be effectively separated from the vacuum source 30 so that a stable vacuum retaining force can be maintained. As shown schematically in FIG. 24, a chamber 50 was arranged between the vacuum pocket 24 and vacuum source 30 to condense the vaporized coolant drawn from the vacuum pocket 24 before it reached the vacuum pump 30. As coolant accumulated to a certain level, it was drained out through an outlet 52 located near the bottom of the chamber 50. The vacuum retaining force was effectively maintained by this arrangement. It was found that a higher vacuum retaining force was obtained when the shoe 10 was supplied with fluid to the hydrostatic pockets 14, 34. One possible explanation is that the coolant surrounding the vacuum pocket 24 can help seal the vacuum pocket 24 so as to increase vacuum level as well as the effective area of the vacuum pocket 24.

The load carrying capacity and stiffness of the vacuum-hydrostatic shoe 10 are of primary importance to the shoe centerless grinding process. The former determines the ability of the shoe 10 to support the workpiece subjected to a grinding force while the latter determines the ability of maintaining the position of the workpiece under a dynamic situation. A shoe with a larger load carrying capacity can be used in applications involving more aggressive grinding. Similarly, a shoe with a higher stiffness can minimize location error and thus increase the accuracy of the workpiece. Because there exists a peak on the stiffness curve, the vacuum-hydrostatic shoe 10 should be designed with a load capacity capable of balancing the static components of the grinding force.

For a given design, the load carrying capacity and stiffness of the vacuum-hydrostatic shoe increase with a reduced design clearance. Hence, if a large load capacity and high stiffness are needed, a vacuum-hydrostatic shoe 10 should be designed to have a small clearance between the support surface and workpiece. However, if the design clearance is too small, the vacuum-hydrostatic shoe 10 will be more sensitive to dimensional change of a workpiece during the grinding process. Additionally, small clearances between the shoe and workpiece will be more easily clogged by dirt and grinding debris. Further, small clearances make provision of hydrostatic lubrication to the workpiece more dependent on workpiece surface condition.

Figure 10:
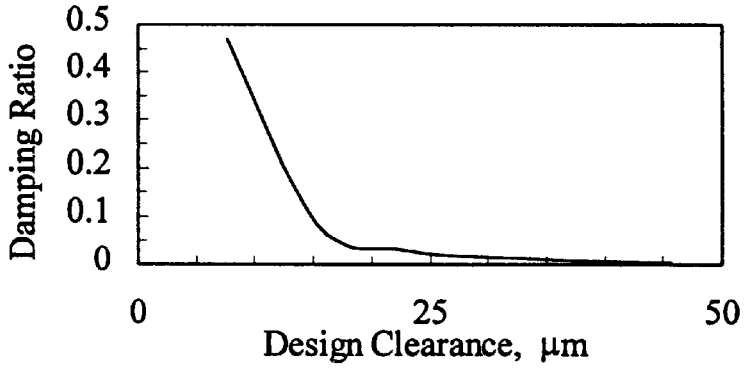
FIG. 10 is a graph of damping capability versus design clearance for a vacuum-hydrostatic shoe.
Figure 11:
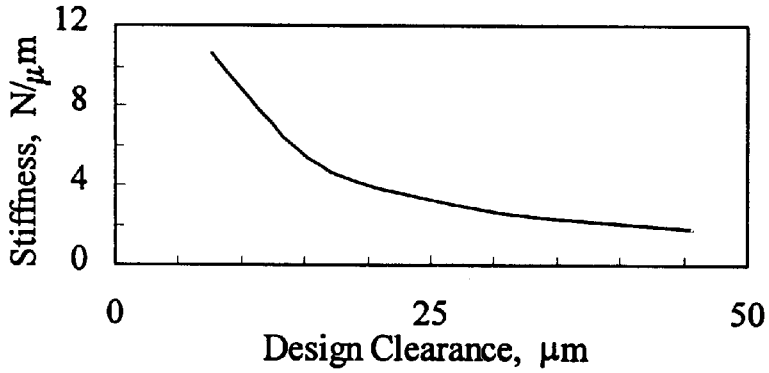
FIG. 11 is a graph of stiffness versus design clearance for a vacuum-hydrostatic shoe.

Damping capability is another prominent feature of the vacuum-hydrostatic shoe 10. In conventional shoe centerless grinding, lobing and chatter are the two detrimental phenomena that are related to the stability of the dynamic grinding process. Increased damping capability and enhanced support stiffness will improve the dynamic stability of the centerless grinding process or eliminate certain lobing and chatter frequencies of the grinding system. As shown in FIG. 10, a relationship is established between the damping capability and the design clearance of the vacuum-hydrostatic shoe. The fluid supply pressure is assumed to be 0.2 MPa and the resistance ratio 2.72. An increased damping capability can be obtained with a decreased design clearance because of the increased squeeze effect. Similarly, under the same conditions, the support stiffness increase with the decrease of the design clearance is shown in FIG. 11. Nevertheless, the design clearance has a more profound effect on the damping capability than on the support stiffness of the vacuum-hydrostatic shoe.

Figure 1:
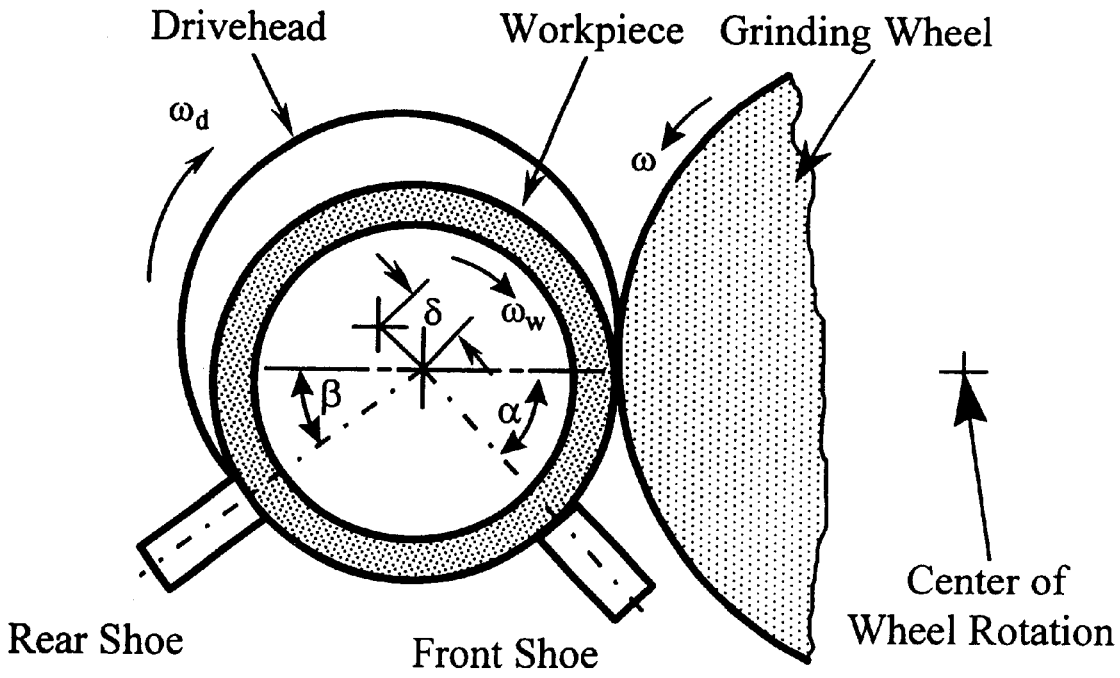
FIG. 1 (PRIOR ART)
FIG. 1 is a schematic representation of a conventional shoe centerless grinding system.
Figure 12:
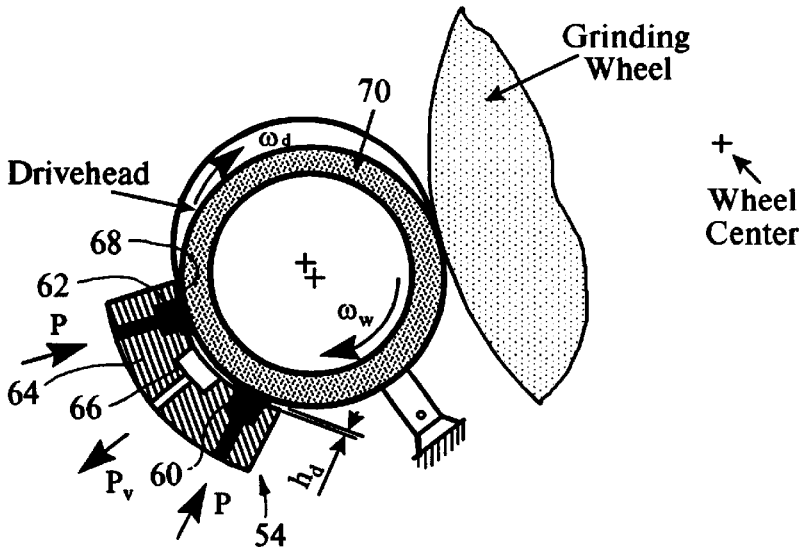
FIG. 12 is a schematic view of a centerless grinding system comprising an inventive curved vacuum-hydrostatic shoe.
Figure 15:
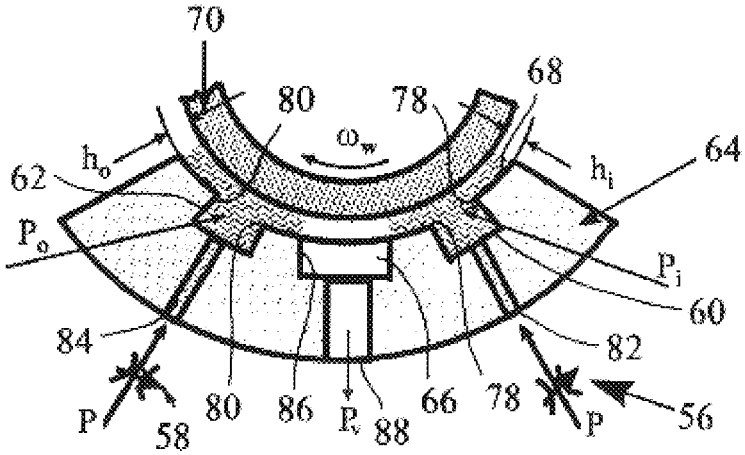
FIG. 15 is a schematic view of a curved vacuum-hydrostatic shoe incorporating hydrostatic fluid flow restrictors.

An embodiment of the vacuum-hydrostatic shoe 54 with a curved support surface 68 is schematically shown in FIGS. 12 and 15. Because the curved vacuum-hydrostatic shoe 54 combines a pressurized fluid with a vacuum, it possesses the advantages listed in Table 4 over the conventional contact type shoe shown in FIG. 1.

TABLE 1

| Features | Conventional shoe | Vacuum-hydrostatic shoe |
|---|---|---|
| workpiece roundness error | small | very small |
| load carrying capacity | large | very large |
| support stiffness | high | very high |
| lobing and chatter control | good | excellent |
| mechanical filter effect | negligible | significant |
| damping capability | fair | superior |
| workpiece contact deformation | large | very small |
| workholding stability | good | very good |

TABLE 1-continued

| Features | Conventional shoe | Vacuum-hydrostatic shoe |
|---|---|---|
| shoe wear | yes | no |
| workpiece burns | yes | no |
| high speed grinding | limited | applicable |
| process automation | good | very good |

The curved vacuum-hydrostatic shoe 54 comprises a first hydrostatic pocket 60 at the leading or entrance edge of the shoe pad 64 and a second hydrostatic pocket 62 at the trailing or exit edge of the shoe pad. The vacuum-hydrostatic shoe 54 also comprises a vacuum pocket 66 intermediate the shoe pad 64 leading and trailing edges. Each hydrostatic pocket 60, 62 includes a first pressure opening, 78 and 80 respectively, which is defined in the support surface 68. A second pressure opening 82 and 84 respectively, is fluidly coupled to the respective first pressure opening and a supply of pressurized fluid 20. The vacuum pocket 66 includes a first vacuum opening 86 defined in the support surface and a second vacuum opening 88 fluidly connected to the first vacuum opening 86 and a source of vacuum 30. The hydrostatic pockets 60, 62 generate a hydrostatic pressure on the workpiece surface to support the workpiece 70, without contacting the shoe while the vacuum pocket 66 prevents the workpiece from being pushed away by the hydrostatic pressure, and hence increases the support stiffness and load capacity. The problems associated with conventional shoe support systems, such as workholding instability, geometric instability, dynamic instability, shoe wear and burn, are eliminated or significantly mitigated. In FIG. 15, the hydrostatic pressure Ps is equally applied and regulated by two individual restrictors 56, 58 to the pockets 60, 62 on the two sides of the shoe pad 64, while the vacuum Pv is applied to the vacuum pocket 66 intermediate the ends of the shoe pad 64.

When using an orifice restrictor for the curved vacuum-hydrostatic shoe 54, the retaining load and stiffness can be expressed by the following equations:

$$T = \frac{2A_v^p P_s}{(1 + R_i / R_o)} - P_v A_v^v$$

$$\frac{dT}{dh} = \frac{12 P_s A_v^p \xi (1 + \xi)}{h_d (1 + R_i / R_o)^2 (1 + 2R_i / R_o)} \left(\frac{h}{h_d}\right)^5$$

where Ps and Pv are the pocket pressures and vacuums respectively, and $A_v^P$ and $A_v^v$ the effective areas of the hydrostatic pockets 60, 62 5 and vacuum pocket 66; $h_d$ and h design and working clearances; $R_i$ and $R_o$ the inflow and outflow resistances at a working clearance; $R_{jd}$ and $R_{od}$ the inflow and outflow resistances, and $\xi = R_{jd}/R_{od}$ or the resistance ratio at the design clearance.

Figure 13:
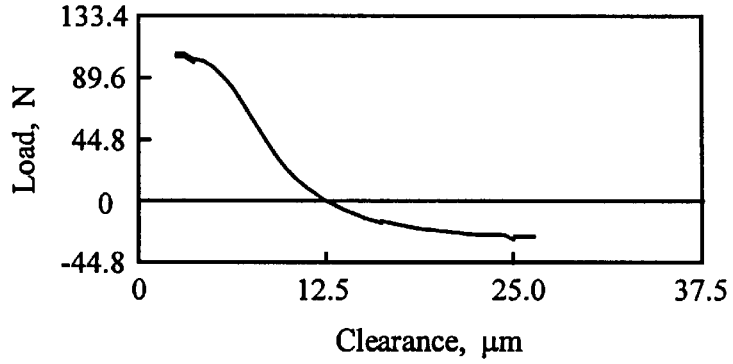
FIG. 13 is a graph of a simulation of load capability versus working clearance for a vacuum-hydrostatic shoe.
Figure 14:
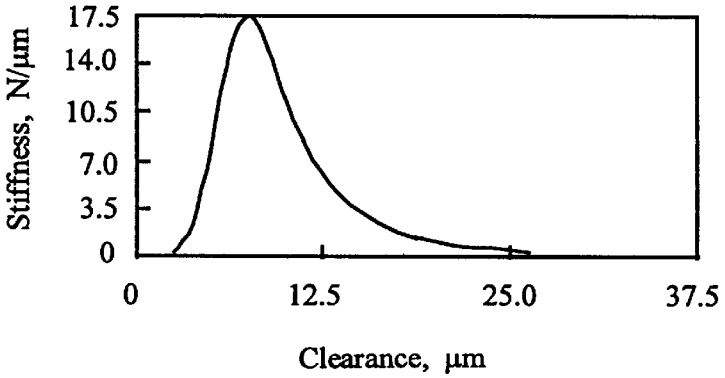
FIG. 14 is a graph of a simulation of stiffness versus working clearance for a vacuum-hydrostatic shoe.

FIGS. 13 and 14 show computer simulation examples of retaining load and supporting stiffness for a curved vacuum-hydrostatic shoe based on a workpiece 42 mm in diameter and 12 mm in width. The simulation results demonstrate that the shoe provides a high stiffness and a large load capacity support.

Since the working clearance changes with the change of applied load, grinding debris or fractured abrasive grains from the grinding wheel may become partially embedded on the workpiece surface which can lead to scratching of the shoe support surface 68. In this regard, the support surface 68 of the shoe 54 could be coated with a soft material such as, for example, polymers, plastics, copper, etc. of approximately 10 $\mu$m in thickness.

Because the shoe centerless grinding system is a dynamic system, the working clearance between a workpiece and a shoe may not be uniform along the contact length if the grinding system is not stable, or if the workpiece diameter is subjected to a significant reduction in the course of the grinding process. The working clearance should be kept constant in the contact region, otherwise contact conditions will be altered that could lead to locating errors of the workpiece and workholding instability problems. The changes in working clearance may be compensated for by an appropriate arrangement of the hydrostatic fluid flow restrictors 56, 58 as shown in FIG. 15. Two restrictors 56, 58 are used to regulate the pressures in the hydrostatic pockets 60, 62. Hydrostatic fluid pressure $P_o$ is introduced to both pockets 60, 62 so that both pockets should have the same hydrostatic pressure if a uniform working clearance is maintained. An increase in the working clearance at either side of the shoe pad 64 will result in a pressure drop, and hence a decreased load supporting ability and a decreased stiffness of the corresponding pocket, and may result in a pressure increase, and hence an increased load supporting ability and an increased stiffness in the other pocket. As a consequence, the working clearance at the pocket of the higher stiffness is decreased less than the working clearance at the pocket of the lower stiffness. Therefore, the pocket pressures are automatically regulated and any changes in the working clearance are self-compensated for by the vacuum-hydrostatic shoe 54.

Metalworking fluids can be used as the fluid supplied to the vacuum-hydrostatic shoe 54. Since the vacuum-hydrostatic shoe combines vacuum with a hydrostatic bearing, it is not unusual that the fluid may enter the vacuum pocket 66, which can decrease the vacuum level. Two approaches can be considered to solve the problem, water evaporation and water separation. Evaporation of water will take place if there is any water entering a vacuum pocket where a higher vacuum level, such as in the order of $10^{-2}$ Torr, is used. Because the evaporation pressure of water is almost two orders of magnitude higher than the vacuum pocket pressure, upon entering the vacuum pocket 66, water will be immediately evaporated and pumped out by a special vacuum pump (not shown).

Figure 24:
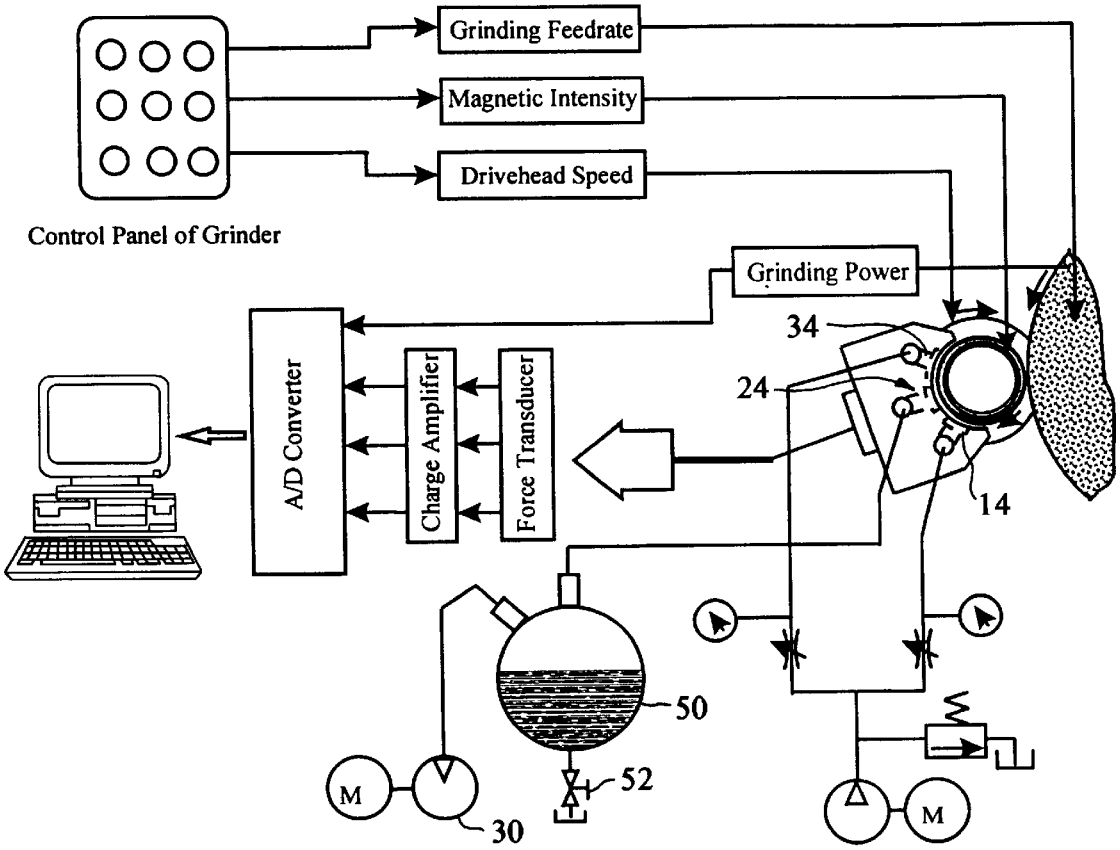
FIG. 24 is a schematic illustration of a centerless grinding setup incorporating a curved vacuum-hydrostatic shoe.

Alternatively, or in conjunction with vacuum evacuation, water separation can also be used to remove water entering the vacuum pocket 66. If water drawn from the vacuum pocket 66 is effectively separated, a stable vacuum retaining force can be maintained. As shown in FIG. 24, a chamber 50 was arranged between the vacuum pocket 66 and the vacuum source 30 to condense the vaporized coolant from the vacuum pocket 66 before it reached the vacuum pump 30. As coolant accumulates to a certain level, it can be drained out through an outlet 52 located near the bottom of the chamber 50. The vacuum retaining force was effectively maintained by this arrangement. It was found that a higher vacuum retaining force was obtained when the hydrostatic pockets 60, 62 of the vacuum-hydrostatic shoe 54 were supplied with hydrostatic fluid. One possible explanation is that fluid surrounding the vacuum pocket 66 can help seal the vacuum pocket 66 so as to increase vacuum level as well as the effective area of the vacuum pocket 66.

Because of the viscous property of the fluid used, hydrodynamic cavitation may take place in the hydrostatic pocket 60 near the leading edge of the shoe pad 64. This is especially true when workpiece surface speed increases from a conventional range of 60–180 m/min to a higher range of over 300 m/min. Hydrodynamic cavitation may cause the vacuum-hydrostatic shoe to lose its load supporting ability and stability. Therefore it is important to consider hydrodynamic cavitation problem when designing a vacuum-hydrostatic shoe.

The outflow velocity of hydrostatic fluid coming out of the working clearance is expressed as:

$$V = \frac{P_s h^2}{L R_{od} h_d^3 (R_i / R_o + 1)}$$

where L is the total land length of the shoe pad, and $$R_{od} = \frac{6\eta}{h_d^3\left[\frac{a}{c} + \frac{b}{c} + \frac{\pi}{\ln(c/r_{int} + 1)} - 4\left(1 + \frac{r_{int}}{c}\right)\right]}$$

Figure 16:
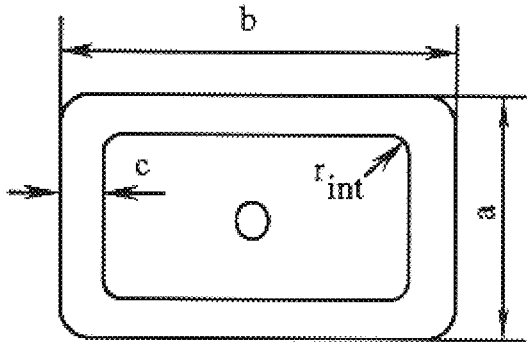
FIG. 16 is a diagrammatic representation of a hydrostatic fluid pocket.

$\eta$ is the dynamic viscosity of the hydrostatic fluid. a, b, c and $r_{int}$ are defined in FIG. 16.

The outflow velocity is a function of the supply pressure of the hydrostatic fluid, the working and design clearances, the total land length of the shoe pad 64, and the ratio of inflow to outflow resistances. In the case of using water as hydrostatic fluid, we can use $\rho$=1,000 kg/m$^3$, $\eta$=1.3×10$^{-3}$ N·S/m$^2$. Assuming that the workpiece surface speed is 300 m/min, the ratio of the inflow to outflow resistances is 1, the mean outflow velocity through the working clearance is then 500 m/min. The hydrostatic cavitation will not occur because the mean outflow velocity is larger than the workpiece surface velocity in this case.

EXAMPLE 2

Figure 17:
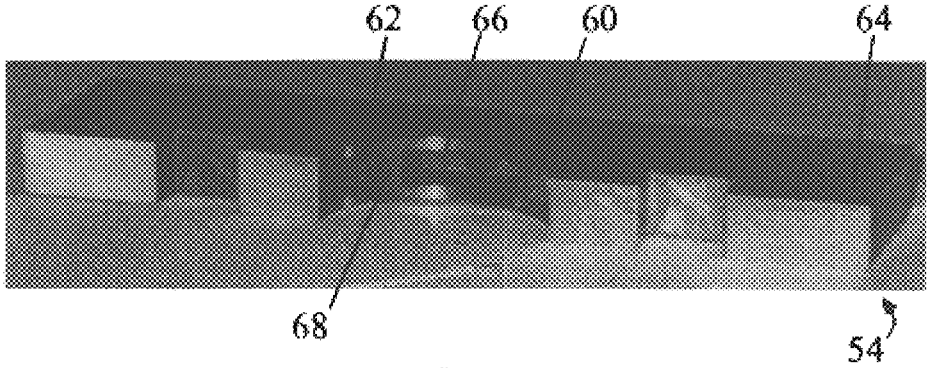
FIG. 17 is a perspective view of a curved vacuum-hydrostatic shoe.

The performance of a curved vacuum-hydrostatic shoe 54 was evaluated under static conditions. Design of a curved vacuum-hydrostatic shoe 54 follows the same methodology as the flat shoe design 10 presented in Example 1. FIG. 17 shows a curved shoe conformable with a circular workpiece (not shown), such as a bearing outer ring. Pressurized liquid, such as metalworking fluid, was supplied from the two hydrostatic pockets 60, 62 arranged at the two edges of the shoe pad 64 while the vacuum pocket 66 was intermediate the edges. This arrangement facilitates maintaining the constant working clearance of liquid film and stabilizing the vacuum level of the shoe. The configuration of the curved vacuum-hydrostatic shoe 54 is determined according to the workpiece dimensions, the design clearance between the workpiece and the support surface 68, and other conditions.

Figure 18:
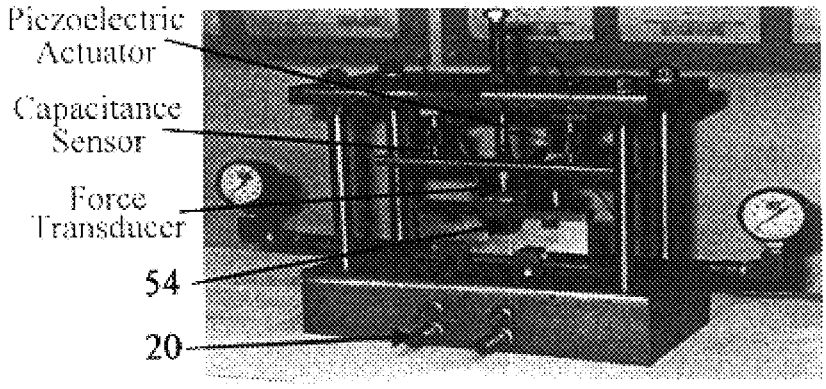
FIG. 18 is a perspective view of a test apparatus for a curved vacuum-hydrostatic shoe.

An apparatus for characterizing the performance of a curved vacuum-hydrostatic shoe 54 and is illustrated in FIG. 18. A hydraulic block served as the central unit to regulate the liquid and vacuum supplies and to support the shoe 54 and the peripheral devices. A curved part, acting as a workpiece, rested on top of the curved shoe pad 64. Attached to the curved part was a Kistler force transducer capable of picking up three force components. Displacement and forces acting on the shoe 54 were monitored through a date acquisition system (National Instruments LabVIEW). Gauges were also used to monitor the supply pressure and vacuum level.

Figure 19:
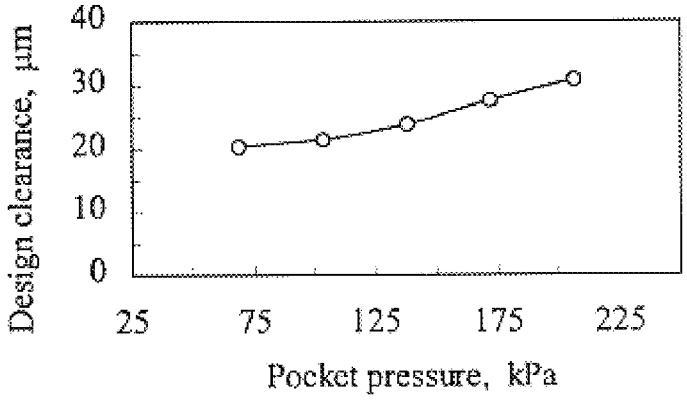
FIG. 19 is a graph of design clearance versus supply pressure for a vacuum-hydrostatic shoe.

The relationship between design clearance and pocket pressure is helpful in controlling design clearance in actual grinding applications by the monitoring of the pocket pressure. When the inflow resistance and dimensions of the shoe pad 64 are decided, the design clearance of the vacuum-hydrostatic shoe 54 and workpiece 70 is related to the supply pressure. FIG. 19 gives the relationship between the design clearance and pocket pressure.

The support stiffness of the vacuum-hydrostatic shoe is a very important parameter to grinding applications, which can be identified by different means. The support stiffness was obtained by 1) step input and checked by 2) impulse and 3) sinusoidal excitations.

1) System response under step input

Figure 20A:
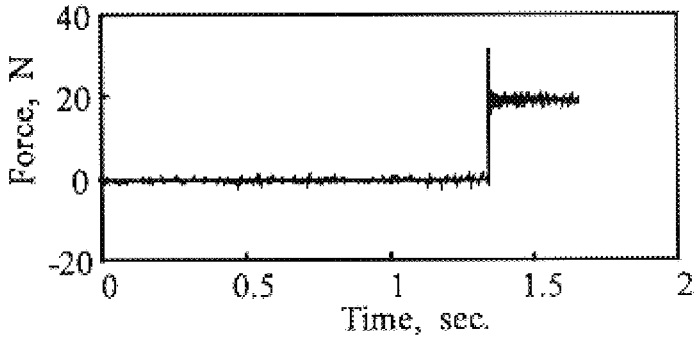
FIG. 20*a* is a graph illustrating response of shoe force to a step input for a vacuum-hydrostatic shoe.
Figure 20B:
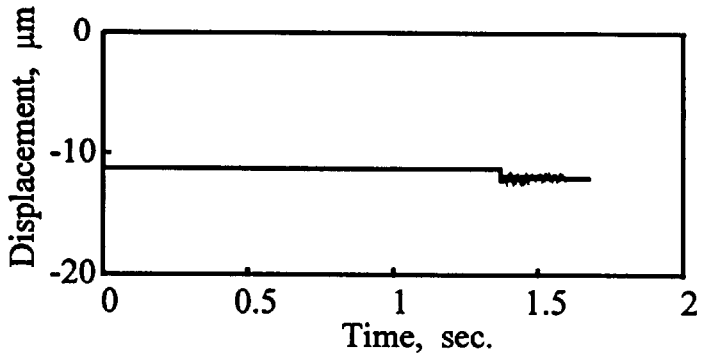
FIG. 20*b* is a graph illustrating response of shoe displacement to a step input for a vacuum-hydrostatic shoe.

Using a piezoelectric actuator, a step input of displacement was applied to the curved vacuum-hydrostatic shoe 54. The displacement of the shoe liquid film and the forces between the shoe 54 and its mating workpiece 70 were detected by the capacitance sensors and the piezoelectric force transducer. At the clearance of 12.5 $\mu$m, the static stiffness of the curved vacuum-hydrostatic shoe was 15 N/$\mu$m which is shown in FIGS. 20*a* and 20*b*.

2) System response under impulse input

Figure 21A:
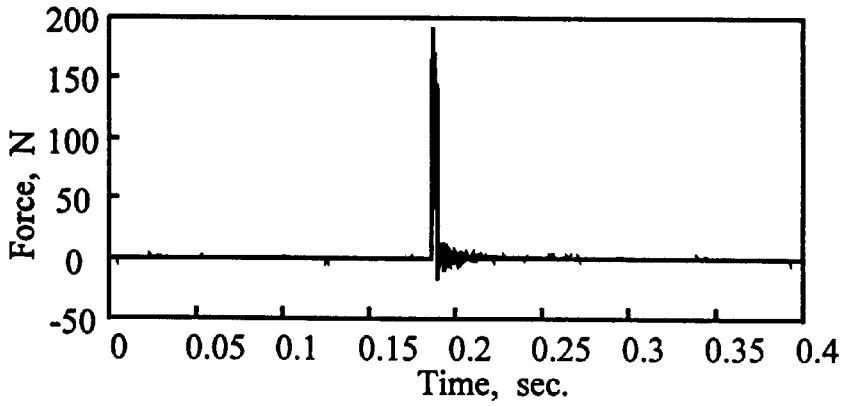
FIG. 21*a* is a graph illustrating response of shoe force to an impulse excitation for a vacuum-hydrostatic shoe.
Figure 21B:
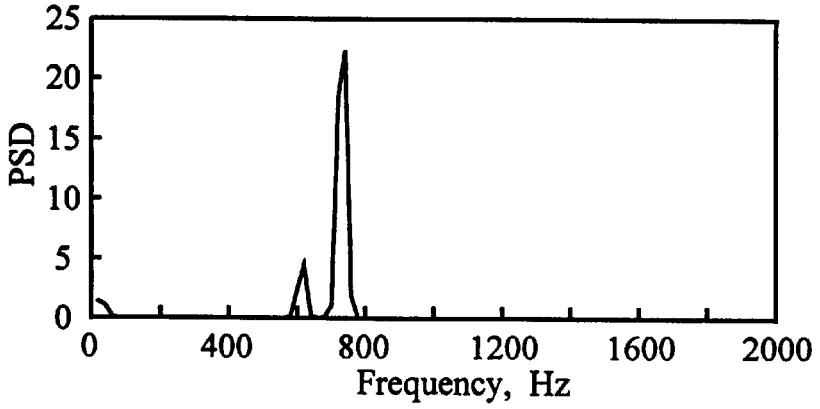
FIG. 21*b* is a graph illustrating Power Spectrum Density of the force on a shoe to an impulse excitation for a vacuum-hydrostatic shoe.

The mating part had a mass of 0.9992 kg. For the stiffness of 15 N/$\mu$m at the clearance of 12.5 $\mu$m, the natural frequency was 617 Hz. From the Power Spectrum Density analysis of the force signal as shown in FIGS. 21*a* and 21*b*, two frequencies are identified. One is related to natural frequency of the curved vacuum-hydrostatic shoe around 617 Hz, the other is close to the natural frequency of the hydraulic frame which is 73 8 Hz.

3) System response under scanning sinusoidal input

Figure 22:
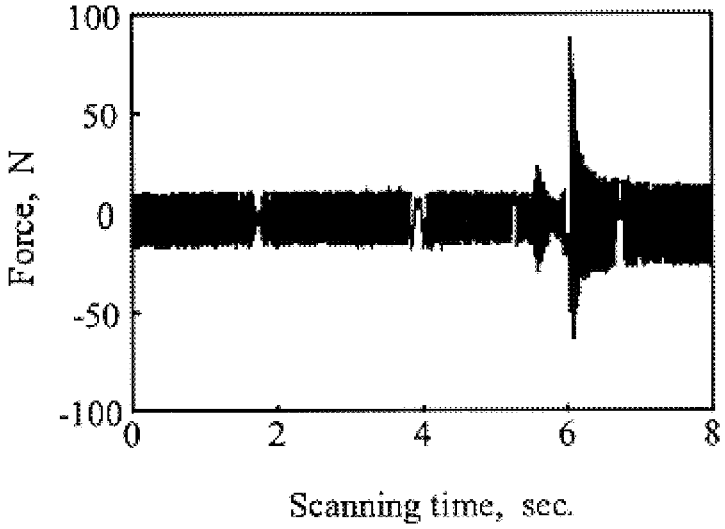
FIG. 22 is a graph of the response of a vacuum-hydrostatic shoe after sinusoidal excitation with frequencies scanning from 100 Hz to 1,000 Hz.

Sinusoidal excitation was also applied to the curved vacuum-hydrostatic shoe at different working clearances. As shown in FIG. 22, at a working clearance of 12.5, $\mu$m and a film stiffness of 15 N/$\mu$m, there were two dominant natural frequencies in the range of 100 Hz to 1,000 Hz. The first peak related to the natural frequency of the curved shoe at 617 Hz and the second corresponded to the natural frequency of the hydraulic frame at 738 Hz. The film had a large damping coefficient compared to the hydraulic frame in terms of the magnitude of response.

EXAMPLE 3

Figure 23:
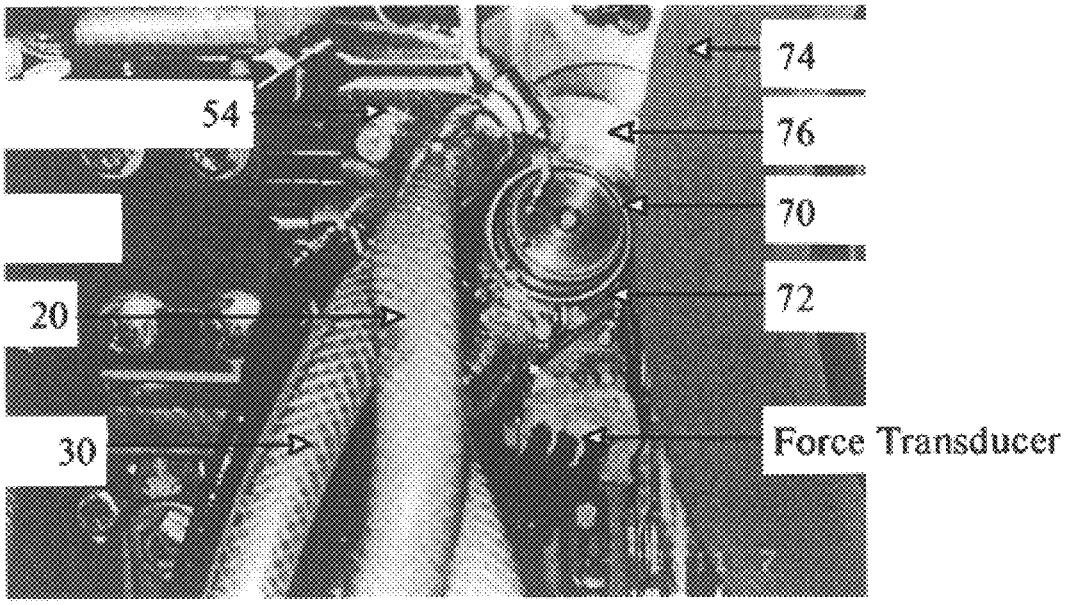
FIG. 23 is a schematic view of a centerless grinder incorporating a curved vacuum-hydrostatic shoe.
Figure 28:
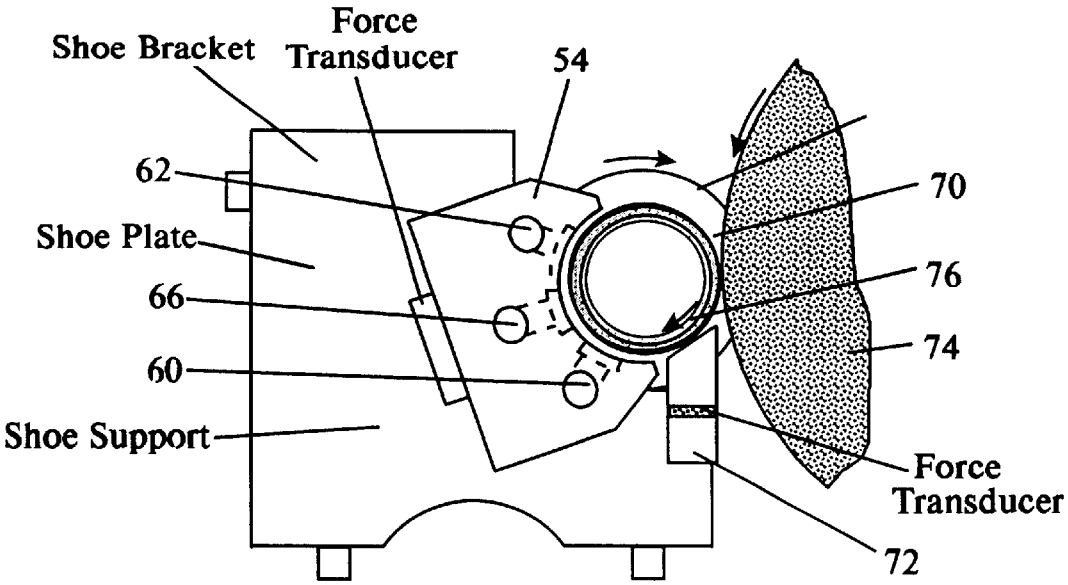
FIG. 28 is a schematic view of a shoe centerless grinder incorporating an inventive curved vacuum-hydrostatic shoe.
Figure 29A:
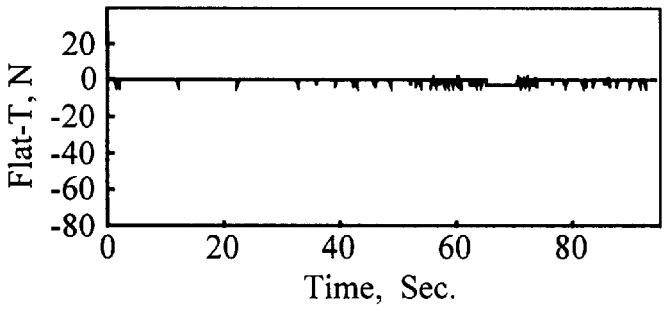
FIG. 29*a* is a graphical illustration of the tangential force on a conventional front shoe in a centerless grinding operation using a vacuum-hydrostatic shoe.
Figure 29B:
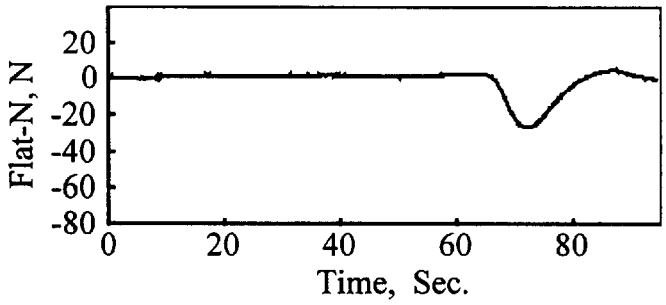
FIG. 29*b* is a graphical illustration of the normal force on a conventional front shoe in a centerless grinding operation using a vacuum-hydrostatic shoe.
Figure 29C:
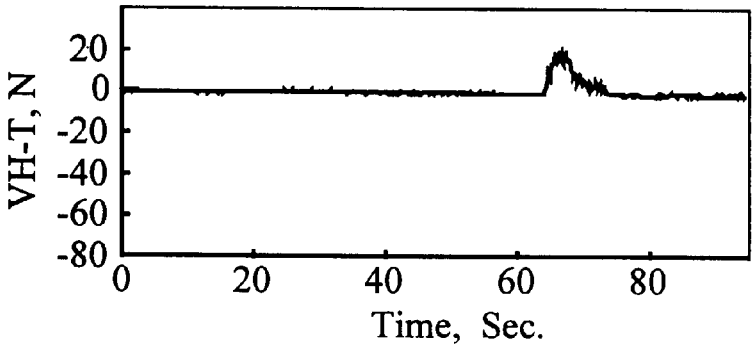
FIG. 29*c* is a graphical illustration of the tangential force on a vacuum-hydrostatic shoe in a centerless grinding operation using a vacuum-hydrostatic shoe.
Figure 29D:
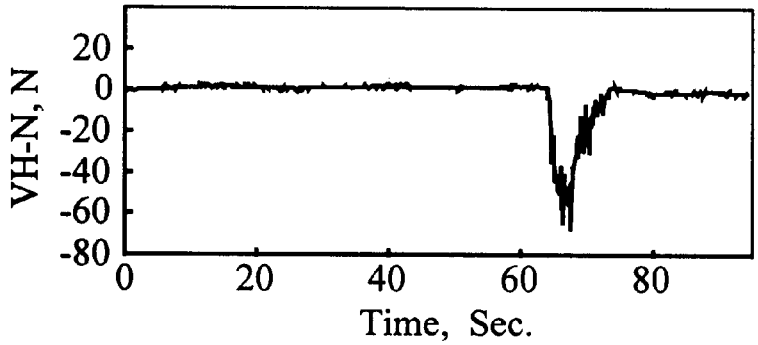
FIG. 29*d* is a graphical illustration of the normal force on a vacuum-hydrostatic shoe in a centerless grinding operation using a vacuum-hydrostatic shoe.
Figure 29E:
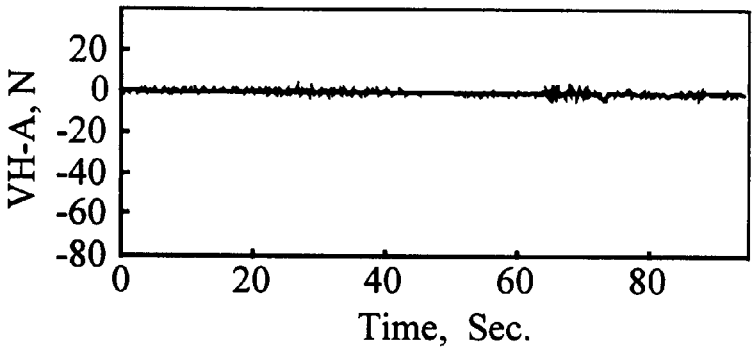
FIG. 29*e* is a graphical illustration of the axial force on a vacuum-hydrostatic shoe in a centerless grinding operation using a vacuum-hydrostatic shoe.
Figure 29F:
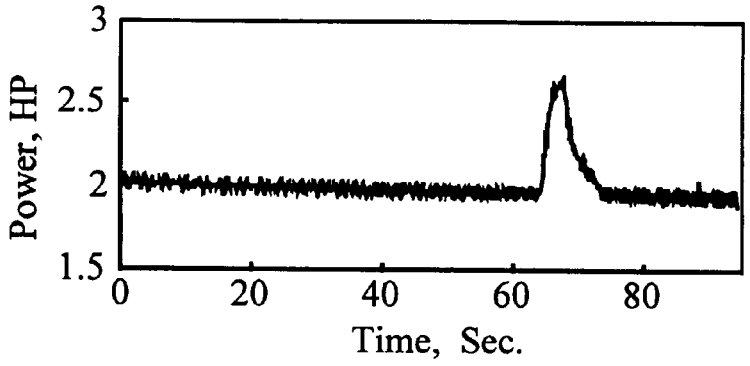
FIG. 29*f* is a graphical illustration of the power used by the grinding wheel in a centerless grinding operation using a vacuum-hydrostatic shoe.

The performance of a curved vacuum-hydrostatic shoe 54 was evaluated under actual grinding conditions. As shown in FIG. 23, 24 and 28 a curved vacuum-hydrostatic shoe 54 was attached to a Micro-Centric shoe centerless grinder available from Cincinnati Millacron Corporation, Cincinnati, Ohio. As shown in FIG. 23, the vacuum-hydrostatic shoe 54 was placed at approximately the same position as a conventional rear shoe and a conventional front shoe 72 was arranged at the 5 o'clock position for safety reasons. The front shoe 72 was not required for the workpiece support and could be removed when investigating the performance of the vacuum-hydrostatic shoe 54. The front shoe 72 could also be adjusted to support the workpiece and study the combined effect of the vacuum-hydrostatic shoe 54 and a conventional shoe. The associated pressurized supply system 20 and vacuum system 30 were also added. FIG. 24 schematically illustrates the arrangement of the inventive grinding apparatus. Pressurized coolant is supplied to the two hydrostatic pockets 60, 62 at a constant supply pressure and two restrictors 56, 58 were used to provide a self-compensation effect to the liquid film. Vacuum was maintained between the workpiece and shoe pad 64 through a vacuum system including a chamber 50 which removed fluid entering the vacuum system. A data acquisition system was used to obtain the power output from the grinding wheel 74 and the force output from the vacuum-hydrostatic shoe 54 and the conventional front shoe 72.

Use of the Vacuum-Hydrostatic Shoe Under Machine Idle Conditions

Machine idle conditions comprise a normal grinding cycle with zero depth of cut. The mechanism of workpiece support based on the vacuum-hydrostatic shoe 54 is different from that of the conventional shoe centerless grinding process. The difference includes zero shoe friction force because of the non-contact support of the workpiece and large contact interface of liquid film. The roles of system parameters, such as offset, magnetic intensity, drivehead speed, and shoe angles, can be quite different from a conventional shoe centerless grinding process given use of the vacuum-hydrostatic shoe.

On the basis of the load carrying capacity and support stiffness of the vacuum-hydrostatic shoe 54, the system parameters can be optimized so that the vacuum-hydrostatic shoe 54 can support an even larger contact load. Since the vacuum-hydrostatic shoe support is found to be insensitive to variations in the system parameters, it is beneficial to the stability of the shoe centerless grinding process. The effects of the system parameters on the shoe normal, tangential, and axial forces are presented below.

1) Effect of magnetic intensity

Figure 25A:
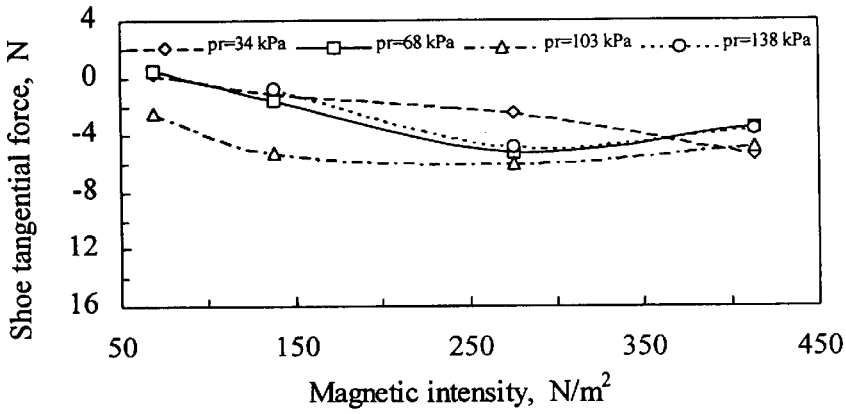
FIG. 25*a* is a graph of tangential force of the vacuum-hydrostatic shoe versus magnetic intensity.
Figure 25B:
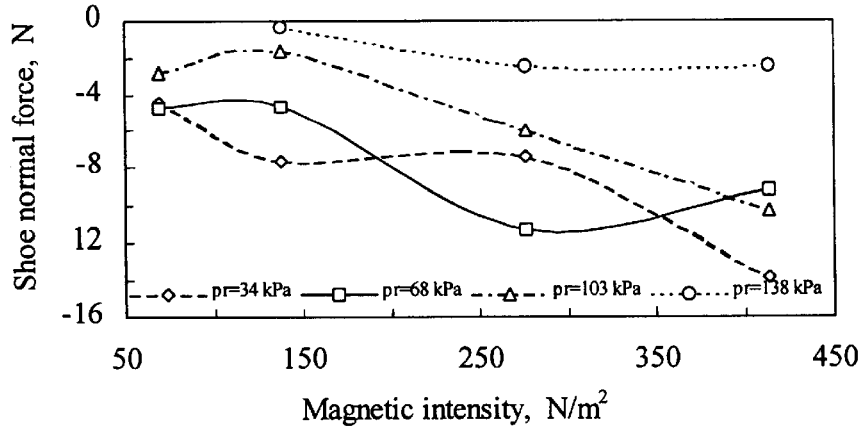
FIG. 25*b* is a graph of normal force of the vacuum-hydrostatic shoe versus magnetic intensity.
Figure 25C:
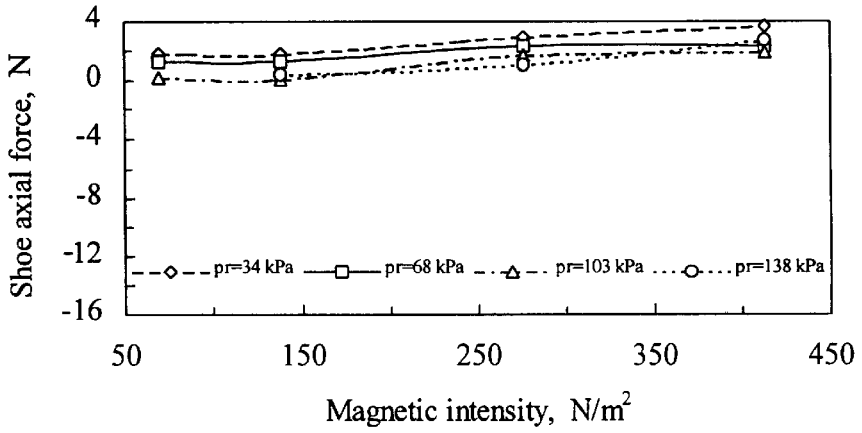
FIG. 25*c* is a graph of axial force of the vacuum-hydrostatic shoe versus magnetic intensity.

Because of the offsets, magnetic intensity can play an important role in providing driving capability to the centerless grinding system. Since the constraining capability given by the conventional shoes is changed due to the use of the vacuum-hydrostatic shoe 54, the grinding system will reach a new equilibrium condition under which both the driving capability and constraining capability are equalized. FIGS. 25*a–c* illustrate the relationship between the forces acting on the vacuum hydrostatic shoe 54 and the magnetic intensity of the drivehead 76 at a drivehead speed of 500 rpm against various pocket pressures.

2) Effect of drivehead speed

Figure 26:
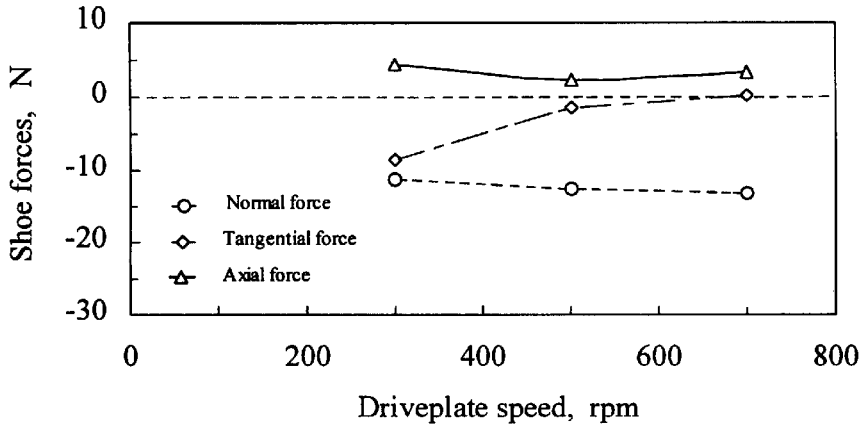
FIG. 26 is a graph of tangential, normal and axial forces of the vacuum-hydrostatic shoe versus drivehead speed.

Generally speaking drivehead speed has more effect on the tangential shoe force component than the normal and axial force components as shown in FIG. 26.

3) Effect of liquid pocket pressure

Figure 27A:
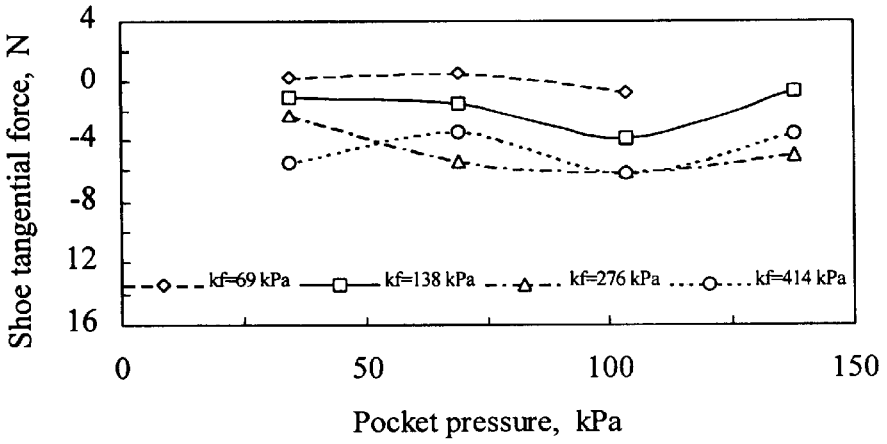
FIG. 27*a* is a graph of tangential force of the vacuum-hydrostatic shoe versus pocket pressure.
Figure 27B:
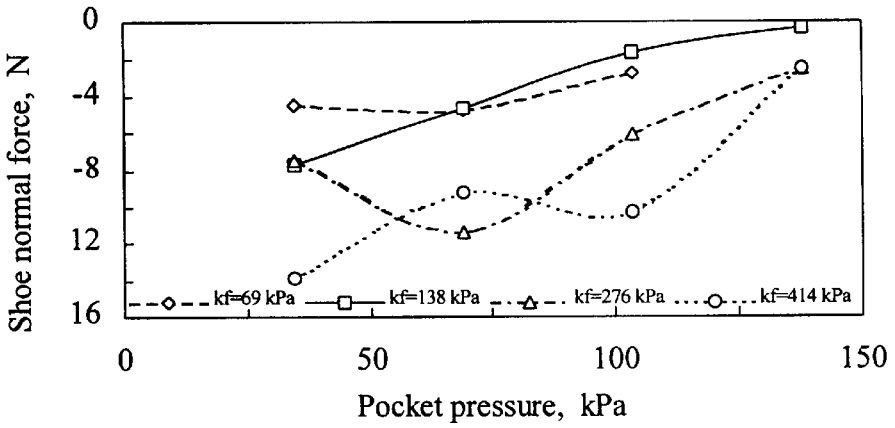
FIG. 27*b* is a graph of normal force of the vacuum-hydrostatic shoe versus pocket pressure.
Figure 27C:
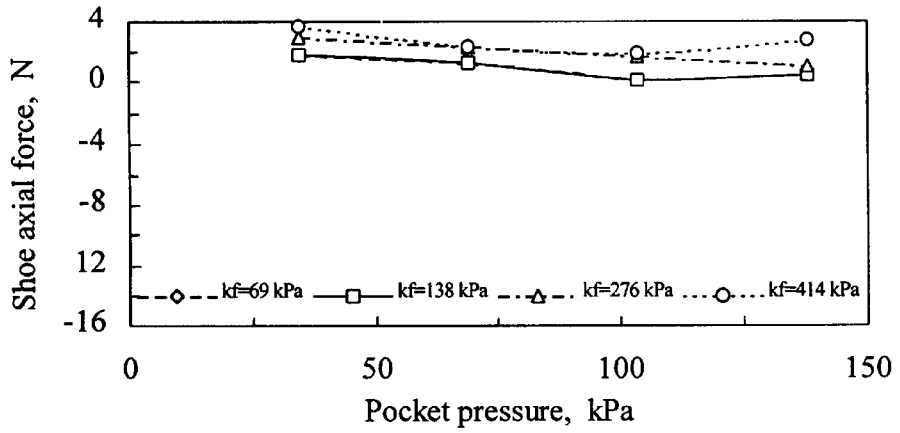
FIG. 27*c* is a graph of axial force of the vacuum-hydrostatic shoe versus pocket pressure.

For a given fluid supply pressure and inflow resistance, the pocket pressure should reflect the design clearance between the vacuum-hydrostatic shoe 54 and the workpiece. A large shoe normal force represents a large preload applied from the magnetic drivehead 76 through frictional driving force. On the other hand, the larger the pocket pressure, the smaller the design clearance of the vacuum-hydrostatic shoe 54. FIGS. 27*a–c* show the relationship between the shoe forces with pocket pressure during the centerless grinding idling test.

4) Effect of workpiece offset

The role of workpiece offset in centerless grinding using the vacuum-hydrostatic shoe 54 is not as significant as in conventional shoe centerless grinding. In testing the vacuum-hydrostatic shoe 54, the offset can be set to almost zero based on the monitoring of the tangential force on the vacuum-hydrostatic shoe in idling. Due to the existing structures of magnetic drivehead and the shoe, the adjustable range of the offset was limited. However, the use of an inventive vacuum-hydrostatic shoe may allow greater offset range than is possible with conventional shoe centerless grinding.

Use of the Vacuum-Hydrostatic Shoe Under Machine Grinding Conditions

The previously described centerless grinding system setup incorporating an inventive vacuum-hydrostatic shoe was used. The performance of the vacuum-hydrostatic shoe was evaluated based on the grinding force and power measurements as well as the roundness of the resulting workpieces.

FIGS. 29*a–f* are graphical examples of the grinding results achieved using the inventive centerless grinding system. The grinding was conducted under the following conditions: magnetic intensity of 138 kPa, drivehead rotational speed of 500 rpm, pocket pressure of 69 kPa, and feed rate of 6 $\mu$m/s with depth of cut of 0.040 mm. For the front shoe 72, the normal force was large compared to the tangential force shown in FIGS. 29*a* and 29*b,* which indicates that the friction at the front shoe 72 is negligible. The force on the vacuum-hydrostatic shoe 54 is larger than that on the front shoe 72. This means that the vacuum-hydrostatic shoe 54 was the main component opposing the grinding force. Comparing the three components of the force acting on the vacuum-hydrostatic shoe 54, the normal force was the largest, then the tangential force, and the least was the axial force. The grinding power was found to be at the same level as that in the conventional shoe grinding for the same material removal rate.

1) Hydrodynamic lubrication effect of the front shoe

In a conventional shoe centerless grinding operation, both the front and rear shoes are in contact with the workpiece through a frictional contact which can be observed from the fact that there exists a tangential and a normal force component on the shoes. In centerless grinding using the vacuum-hydrostatic shoe 54, however, the vacuum-hydrostatic shoe 54 which was placed approximately at the rear shoe position provides non-contact hydrostatic lubrication for the workpiece and the conventional front shoe 72 generates a hydrodynamic lubrication effect for the workpiece if the front shoe is placed close enough to the workpiece. Hydrodynamic lubrication creates a fluid film between the front shoe 72 and workpiece 70 so that no contact occurs. Therefore, the use of a vacuum-hydrostatic shoe 54 in centerless grinding enables the grinding process to have a non-contact workpiece support mechanism even if a conventional front shoe 72 is used.

Figure 30A:
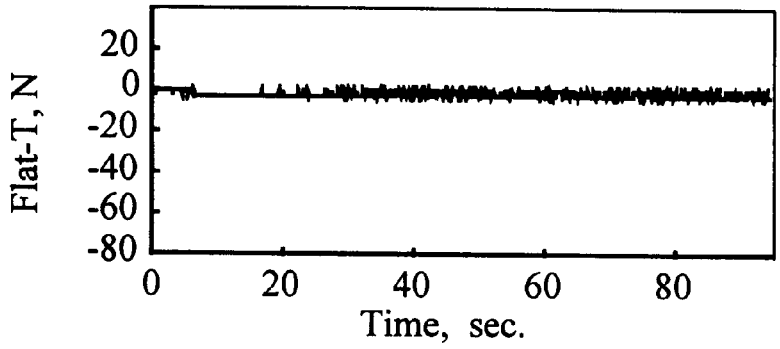
FIG. 30*a* is a graphical illustration of the tangential force on a conventional front shoe due to hydrodynamic lubrication effect during the idling stage of a centerless grinding operation using a vacuum-hydrostatic shoe.
Figure 30B:
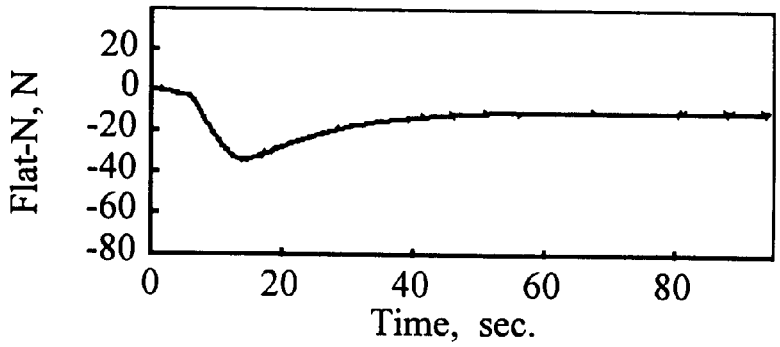
FIG. 30*b* is a graphical illustration of the normal force on a conventional front shoe due to hydrodynamic lubrication effect during the idling stage of a centerless grinding operation using a vacuum-hydrostatic shoe.

The hydrodynamic phenomenon of the front shoe 72 can be shown through an idling test and a grinding test. FIGS. 30*a* and *b* are the results of idling tests in which a grinding cycle proceeded at zero depth of cut. From these Figures it can be observed that the tangential component of the front shoe 72 force was almost zero which depicts a very small friction coefficient due to a hydrodynamic lubrication film. The normal component of the shoe force changed with the film gap change and was finally stabilized at a steady value.

Figure 31A:
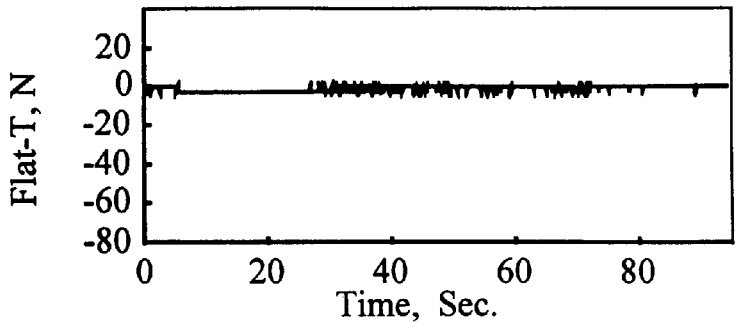
FIG. 31*a* is a graphical illustration of the tangential force on a conventional front shoe due to hydrodynamic lubrication effect during the grinding stage of a centerless grinding operation using a vacuum-hydrostatic shoe.
Figure 31B:
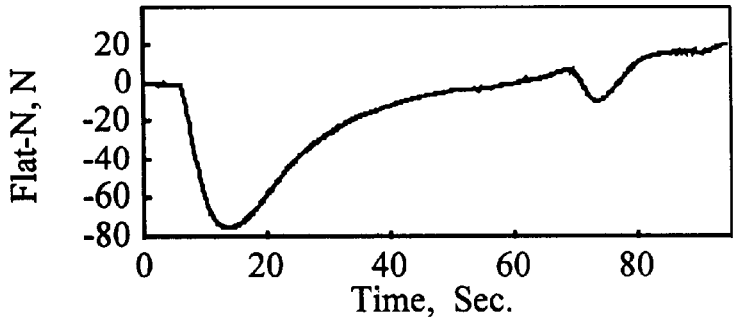
FIG. 31*b* is a graphical illustration of the normal force on a conventional front shoe due to hydrodynamic lubrication effect during the grinding stage of a centerless grinding operation using a vacuum-hydrostatic shoe.
Figure 31C:
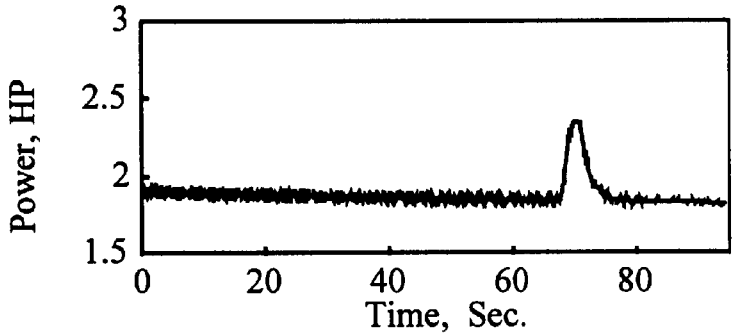
FIG. 31*c* is a graphical illustration of the power used by a grinding wheel during the grinding stage of a centerless grinding operation using a vacuum-hydrostatic shoe.
Figure 31D:
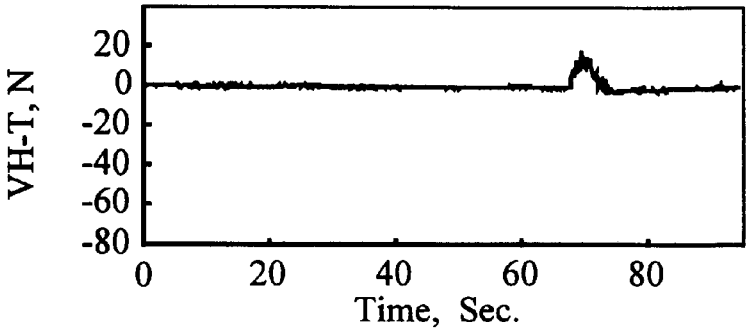
FIG. 31*d* is a graphical illustration of the tangential force on a vacuum-hydrostatic shoe during the grinding stage of a centerless grinding operation using a vacuum-hydrostatic shoe.
Figure 31E:
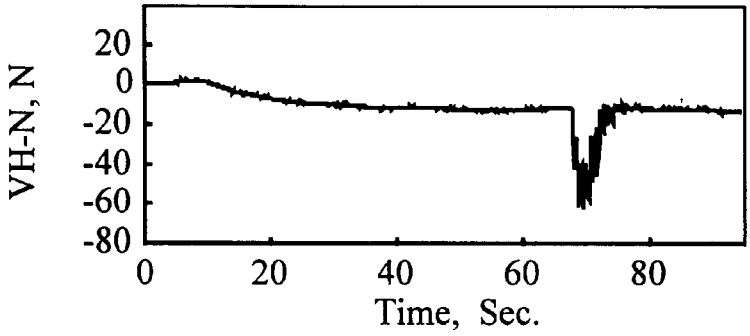
FIG. 31*e* is a graphical illustration of the normal force on a vacuum-hydrostatic shoe during the grinding stage of a centerless grinding operation using a vacuum-hydrostatic shoe.
Figure 31F:
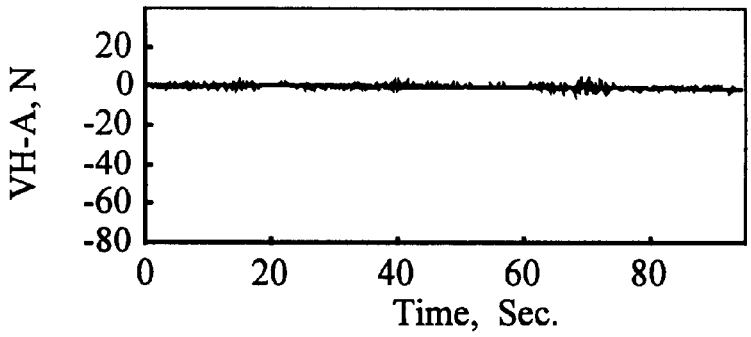
FIG. 31*f* is a graphical illustration of the axial force on a vacuum-hydrostatic shoe during the grinding stage of a centerless grinding operation using a vacuum-hydrostatic shoe.
Figure 32A:
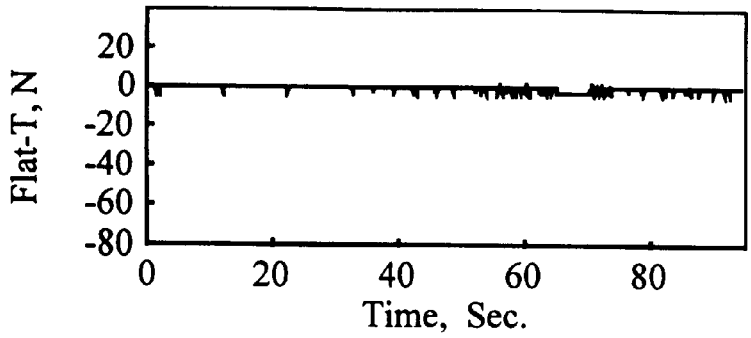
FIG. 32*a* is a graphical illustration of the tangential force on a conventional front shoe during the a centerless grinding operation using a vacuum-hydrostatic shoe with a workpiece having a diameter of 41.91 mm.
Figure 32B:
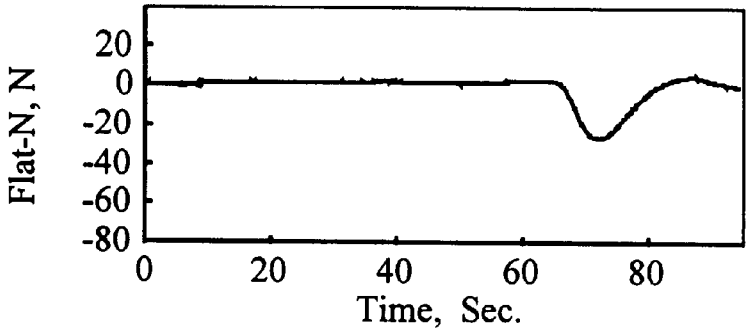
FIG. 32*b* is a graphical illustration of the normal force on a conventional front shoe during a centerless grinding operation using a vacuum-hydrostatic shoe with a workpiece having a diameter of 41.91 mm.
Figure 32C:
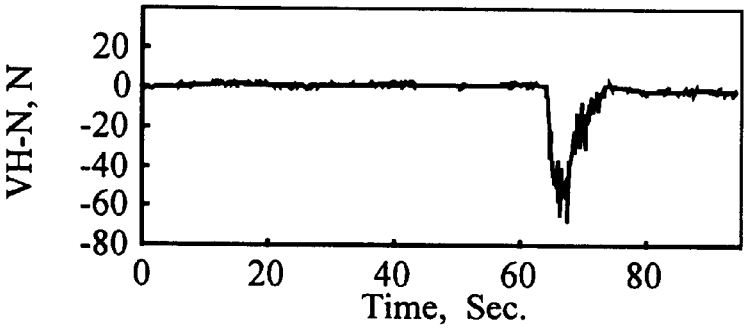
FIG. 32*c* is a graphical illustration of the normal force on a vacuum-hydrostatic shoe during a centerless grinding operation using a vacuum-hydrostatic shoe with a workpiece having a diameter of 41.91 mm.
Figure 32D:
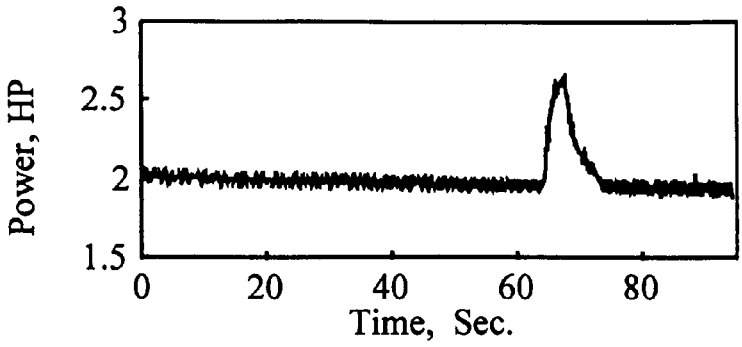
FIG. 32*d* is a graphical illustration of the power used by a grinding wheel during a centerless grinding operation using a vacuum-hydrostatic shoe with a workpiece having a diameter of 41.91 mm.
Figure 33A:
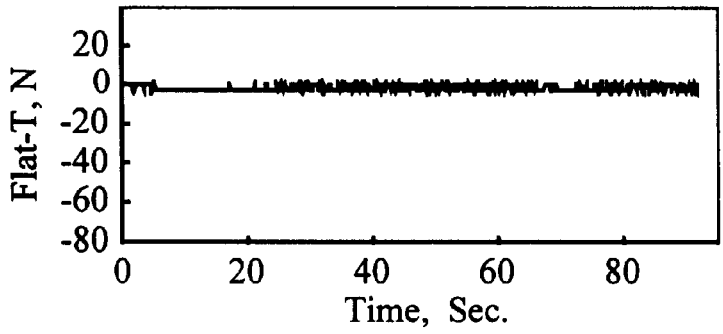
FIG. 33*a* is a graphical illustration of the tangential force on a conventional front shoe during the a centerless grinding operation using a vacuum-hydrostatic shoe with a workpiece having a diameter of 42.00 mm.
Figure 33B:
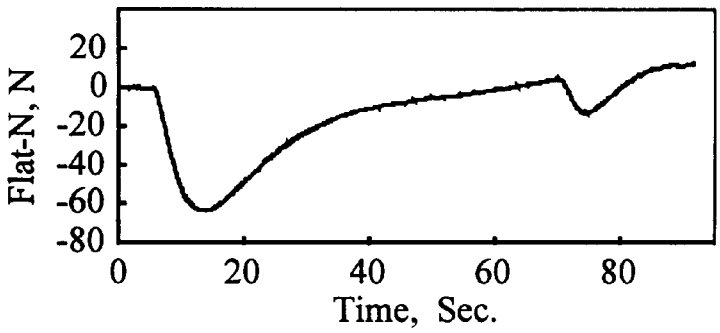
FIG. 33*b* is a graphical illustration of the normal force on a conventional front shoe during a centerless grinding operation using a vacuum-hydrostatic shoe with a workpiece having a diameter of 42.00 mm.
Figure 33C:
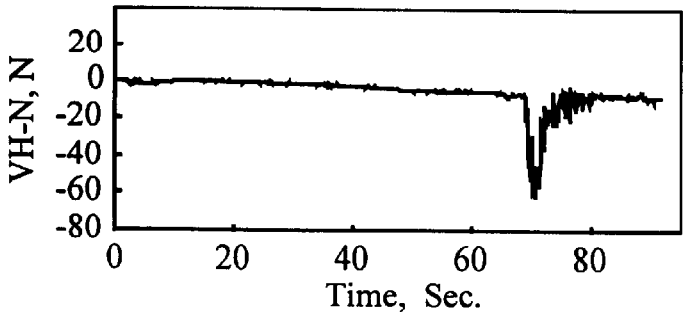
FIG. 33*c* is a graphical illustration of the normal force on a vacuum-hydrostatic shoe during a centerless grinding operation using a vacuum-hydrostatic shoe with a workpiece having a diameter of 42.00 mm.
Figure 33D:
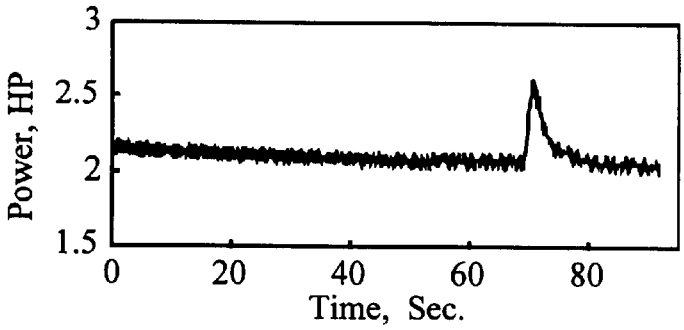
FIG. 33*d* is a graphical illustration of the power used by a grinding wheel during a centerless grinding operation using a vacuum-hydrostatic shoe with a workpiece having a diameter of 42.00 mm.

The hydrodynamic lubrication phenomenon of the conventional front shoe 72 can also be identified from a grinding test result using the vacuum-hydrostatic shoe 54 as shown in FIGS. 31*a–f*. The tangential component of the front shoe force in FIG. 31*a* is negligible and its normal force in FIG. 31*b* increases with the decrease of the gap between the workpiece and the front shoe 72. During grinding, a force is exerted from the workpiece to the front shoe 72 that tends to decrease the gap. The grinding power and forces on the vacuum-hydrostatic shoe 54 also identify the hydrodynamic lubrication effect between the front shoe 72 and the workpiece.

2) Effect of workpiece dimensional change on grinding stability

The effect of workpiece dimensional change on grinding stability was studied by either detecting shoe forces or measuring the resulting ground workpieces. Based on the results of roundness measurements on two sets of workpieces which were of 41.91 mm and 42.00 mm in diameters, there were no significant differences in the roundness values. A similar observation can also be drawn based on the shoe forces in FIGS. 32*a–d* and 33*a–d* because the forces on the vacuum-hydrostatic shoe 54 in both situations were at about the same level regardless of the workpiece diameters. Furthermore, the force on the vacuum-hydrostatic shoe 54 was much larger than that on the front shoe 72, which indicated the dominant role of the vacuum-hydrostatic shoe 54 in centerless grinding. Although the front shoe hydrodynamic lubrication effect existed in both cases, which can be evidenced by the zero tangential component of the front shoe force, the effect of hydrodynamic lubrication was different due to the different gaps between the workpiece and the front shoe. When the workpiece diameter was smaller, as shown in FIGS. 32*a–d* in which the smaller gap between the workpiece and the front shoe 72 could be expected, the smaller hydrodynamic force on the front shoe 72 was obtained compared to the force of larger workpiece diameter shown in FIGS. 33*a–d*. However, conformity between the workpiece diameter and the vacuum-hydrostatic shoe support surface diameter should be considered when a decrease of workpiece diameter is attempted.

3) Workpiece roundness vs. system parameters

Figure 34:
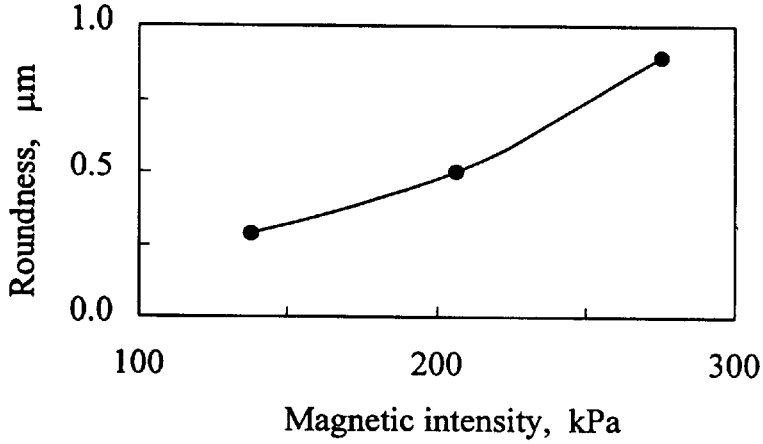
FIG. 34 is a graph of workpiece roundness versus magnetic intensity for workpieces machined on a centerless grinder using a vacuum-hydrostatic shoe.
Figure 35:
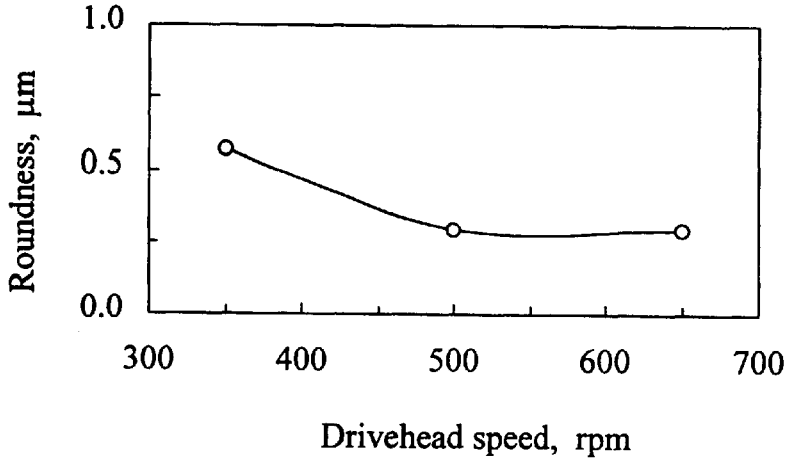
FIG. 35 is a graph of workpiece roundness versus drivehead speed for workpieces machined on a centerless grinder using a vacuum-hydrostatic shoe.

Roundness of workpieces ground with the centerless grinding process is related to the stability of the grinding process. The parameters of the shoe centerless grinding system, such as magnetic intensity and drivehead speed, give effects on workpiece quality and roundness. FIGS. 34 and 35 present roundness data for ground workpieces vs. magnetic intensity and drivehead speed under certain conditions.

a) Magnetic Intensity

The effect of the magnetic intensity of the drivehead 76 on the vacuum-hydrostatic shoe 54 might be due to a large frictional driving force from the drivehead 76. The driving force can cause a large fluctuation in the shoe force and serves as to preload the vacuum-hydrostatic shoe 54 because of the limited stiffness of the vacuum-hydrostatic shoe current design. A design to increase vacuum-hydrostatic shoe stiffness as later described will help overcome this difficulty.

b) Drivehead Speed

Since the drivehead speed affects the driving capability of the drivehead 76, typically a constraining capability is needed to incorporate the driving capability. For example, when there is a change in the drivehead speed, a change in the tangential force on the vacuum-hydrostatic shoe 54 takes place. Based on the idling test results, changes in the drivehead speed did not affect the normal force on the vacuum-hydrostatic shoe 54, and therefore the variation in film thickness was small. However, a low drivehead speed can alter driving capability which gives a negative effect on workpiece roundness as shown in FIG. 35.

The vacuum-hydrostatic shoe 54 improves workpiece quality and process productivity for the shoe centerless grinding process and therefore makes the grinding process more cost-effective. In addition to other salient features, such as good workholding capability and friction free shoe support, the ability to control lobing and chatter is another benefit of the vacuum-hydrostatic shoe when used as part of the centerless grinding system.

Figure 36:
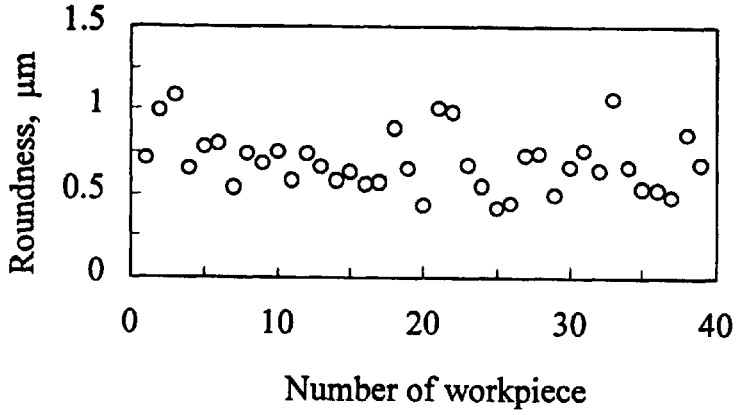
FIG. 36 is a graphical illustration showing a distribution of workpiece roundness for workpieces machined on a centerless grinder using a conventional shoe.
Figure 37:
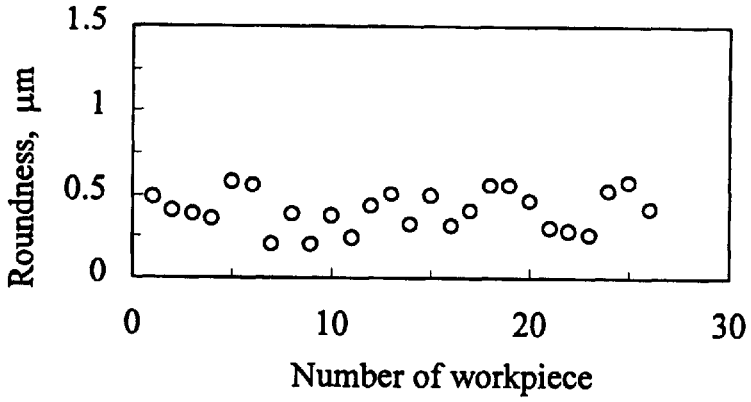
FIG. 37 is a graphical illustration showing a distribution of workpiece roundness for workpieces machined on a centerless grinder using a vacuum-hydrostatic shoe.

The use of a vacuum-hydrostatic shoe in centerless grinding is advantageous compared to conventional shoe centerless grinding. As illustrated in FIG. 36, a roundness distribution was obtained in the range of 0.5~1.0 $\mu$m for workpieces ground using the conventional shoe centerless grinding process using a flat front and a V-pivoting rear shoe. The process was well controlled by maintaining the shoe setup angles to the optimal position, $\alpha$=57° and $\beta$=9°. The workpiece offset $\delta$ was set to have its magnitude and angle close to those typically used in production centerless grinding. The grinding wheel was dressed with a single point diamond, by monitoring the grinding forces and observing the surface finish of resulting workpieces. The magnetic intensity was set to 310 kPa and drivehead speed about 500 rpm. The grinding duration and spark out time of a cycle were also a little bit longer than that typically used in production grinding, for the purpose of achieving optimum workpiece quality and surface finish. The roundness of ground workpieces was measured by a FORMSCAN 3200 (Federal Products Corporation), which had 0.1 $\mu$m resolution and could automatically analyze the lobing spectra of a workpiece. From the measurement results, it was observed that most workpieces had a out-of-roundness error less than 1 $\mu$m which is within the tolerance for a commercially available super precision bearing of the same dimension. The roundness results for workpieces ground by a centerless grinding system using the vacuum-hydrostatic shoe are shown in FIG. 37. After grinding, the workpieces had a roundness distribution in the range of 0.20~0.56 $\mu$m, which is a dramatic improvement over the results based on the conventional shoe centerless grinding process. The best roundness value obtained was 0.20 $\mu$m (7.8 $\mu$inch) even though the Micro-Centric shoe centerless grinder was an older machine manufactured in 1970's. The roundness of the workpieces could have been further improved if the process and system parameters were fully optimized.

Figure 38:
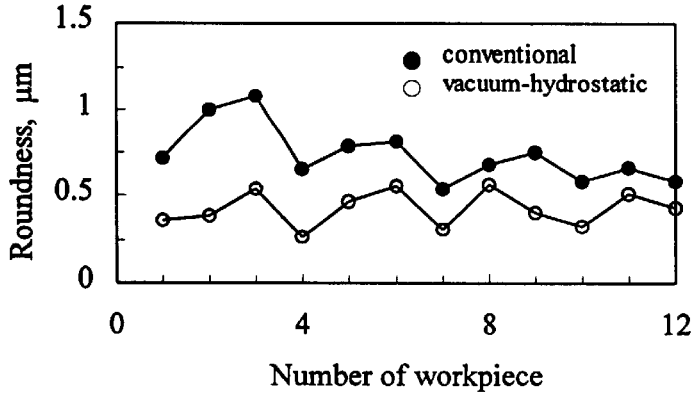
FIG. 38 is a graphical illustration comparing workpiece roundness distributions for workpieces machined on a centerless grinder using a conventional shoe and a vacuum-hydrostatic shoe.

The effectiveness in roundness improvement for centerless grinding using the vacuum-hydrostatic shoe was also evaluated by comparing the roundness values on the same workpieces before and after using the vacuum hydrostatic shoe, as shown in FIG. 38. A significant improvement was again achieved when the vacuum-hydrostatic shoe was used in the centerless grinding process.

Figure 39:
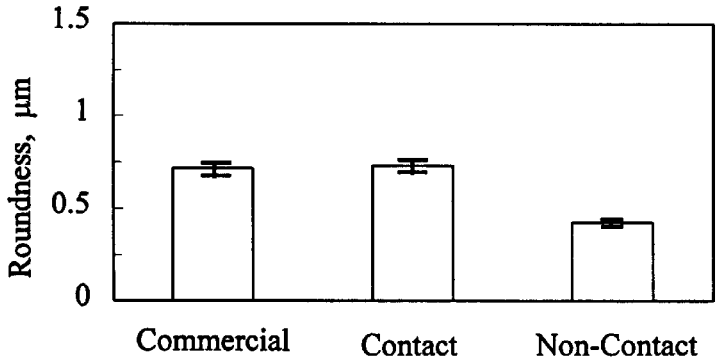
FIG. 39 is a graphical illustration comparing workpiece roundness for commercial super precision workpieces and workpieces machined on a centerless grinder using a conventional shoe and a vacuum-hydrostatic shoe.
Figure 47:
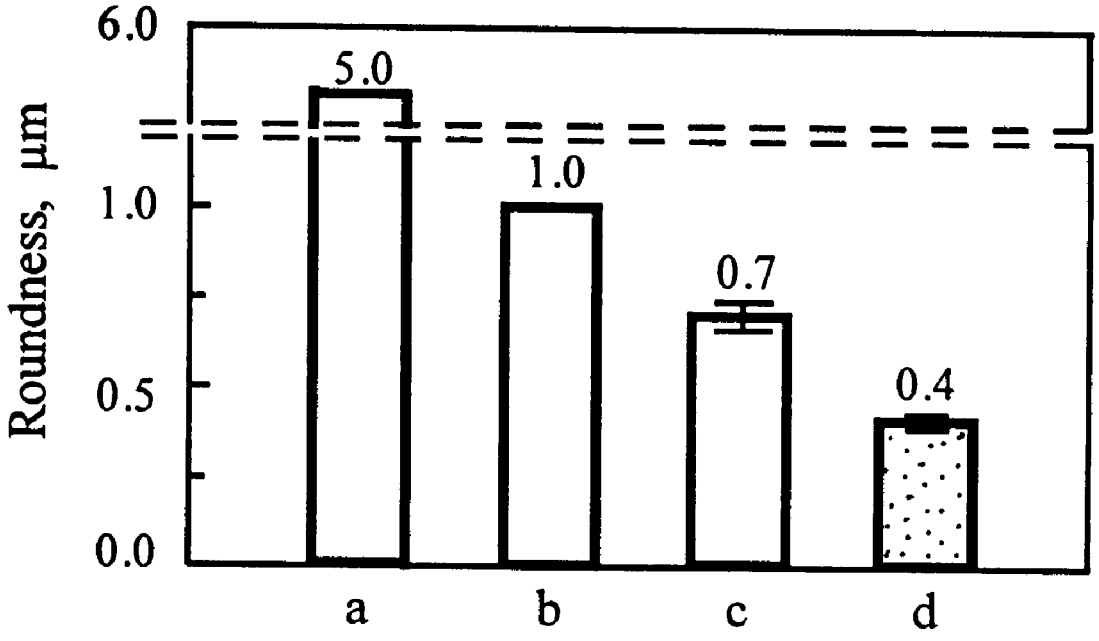
FIG. 47 is a graphical illustration comparing workpiece roundness for (a) the commercial standard for super precision workpieces, (b) commercially available super precision workpieces and workpieces machined on a centerless grinder using (c) a conventional shoe and (d) a vacuum-hydrostatic shoe.

In FIGS. 39 and 47, a general roundness comparison is made for test workpieces ground with a conventional shoe, the vacuum-hydrostatic shoe, and commercially available super precision bearings. The comparison shows out-of-roundness error can be kept at the same level as that for commercial super precision bearings if the conventional shoe centerless grinding process is well controlled. However, the centerless grinding process using the vacuum-hydrostatic shoe can achieve much better workpiece roundness than commercial super precision bearing products or is possible even with a well controlled conventional shoe centerless grinding process. Practically, the use of the vacuum-hydrostatic shoe reduces the out-of roundness error on a workpiece by up to 50%, even given that the grinding system and process parameters are not optimized for the vacuum-hydrostatic shoe. A further reduction in the out-of-roundness error can be expected if optimization of process parameters is performed.

EXAMPLE 4 (Prophetic)

Shoe stiffness is a critical parameter which can affect the dynamic performance of the centerless grinding system. It would be beneficial to the grinding process if the stiffness of the vacuum-hydrostatic shoe could be further increased without decreasing the working clearance. In this section, a perspective is presented to enhance the vacuum-hydrostatic shoe stiffness based on analysis of the existing designs.

Figure 40:
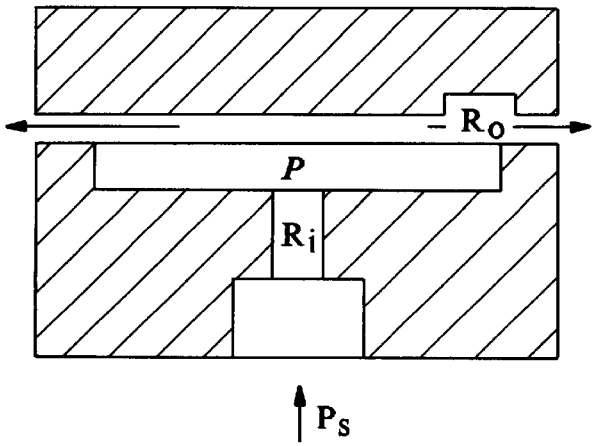
FIG. 40 is a schematic illustration of a conventional hydrostatic bearing.

A conventional hydrostatic bearing has the structure shown in FIG. 40, in which the supplied pressure is regulated by an inflow restrictor Ri to the hydrostatic pocket and pocket pressure is built up because of an outflow restrictor Ro. Usually, the inflow restrictor Ri is either a capillary or an orifice which generates a constant inflow resistance.

Figure 41:
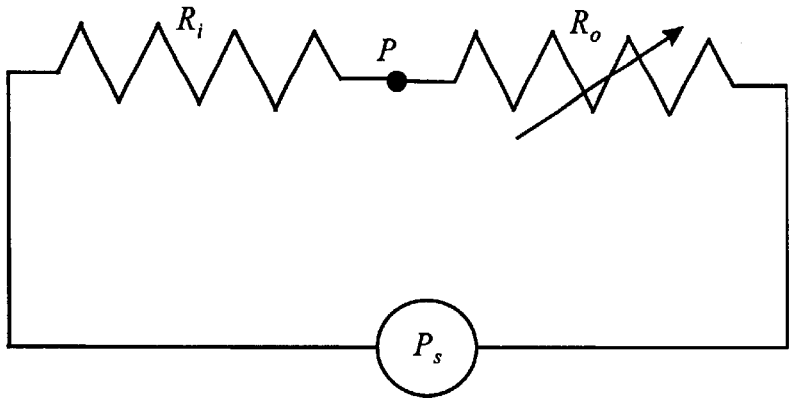
FIG. 41 is a schematic illustration of a circuit equivalent to the conventional hydrostatic bearing of FIG. 40.

On the other hand, the outflow resistance Ro plays an important role in regulating the pocket pressure to withstand the external load of the workpiece. In fact, the outflow resistance Ro is inversely proportional to the cube of the film thickness. A decreased film thickness results in an increased pocket pressure to react against the external load. An equivalent circuit to the bearing is illustrated in FIG. 41.

To achieve high stiffness in hydrostatic bearings, the concept of self-compensation is advanced. Bearing stiffness is a measure of the film thickness change of the bearing with respect to the external load applied. A high stiffness bearing would exhibit a small change in film thickness while a low stiffness bearing shows a large change in film thickness when an external load is applied. A bearing with the self-compensation mechanism would experience zero or a small change in film thickness even if an external load is applied.

Figure 42:
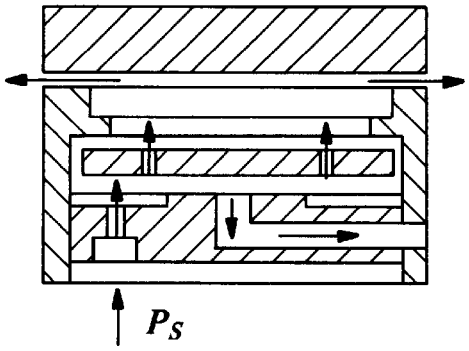
FIG. 42 is a schematic illustration of a high stiffness hydrostatic bearing with a floating disk.
Figure 43:
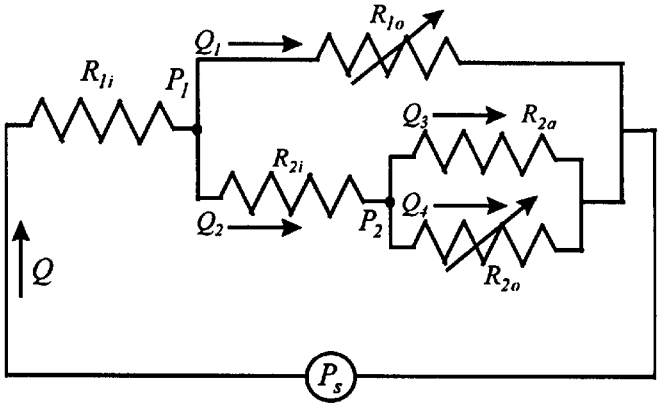
FIG. 43 is a schematic illustration of a circuit equivalent to the high stiffness hydrostatic bearing with a floating disk of FIG. 42.

FIG. 42 shows a design for a high stiffness bearing using a self-controlled floating disk to adjust inflow and outflow restrictors within the bearing. The film thickness during loading remains unchanged regardless of any variations in the pocket pressure if the bearing parameters are properly selected. The equivalent circuit to explain the self-compensation mechanism is shown in FIG. 43, in which the floating disk is a controllable restrictor.

Figure 44:
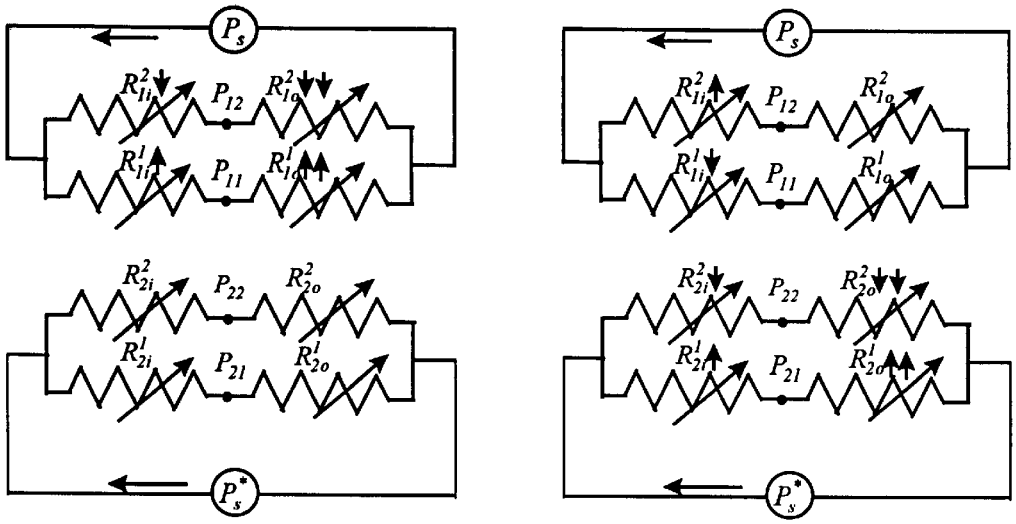
FIG. 44 is a schematic illustration of a circuit equivalent to a self-compensated aerostatic bearing.

An aerostatic bearing with a regulating ring as a controllable restrictor can be represented in terms of an equivalent circuit and is schematically shown in FIG. 44. When the thrust plate is loaded, the resistance change causes a series of corresponding changes in pocket pressure, which consequently maintains the clearance between the thrust plate and the bearing housing (the outflow resistance remains constant).

Figure 45:
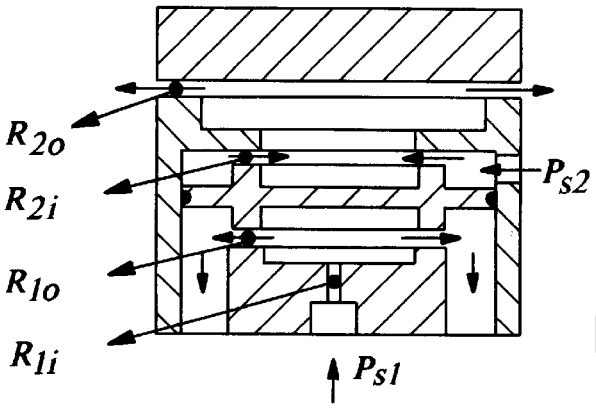
FIG. 45 is a schematic illustration of a self-controlled bearing with two pressure supplies.
Figure 46:
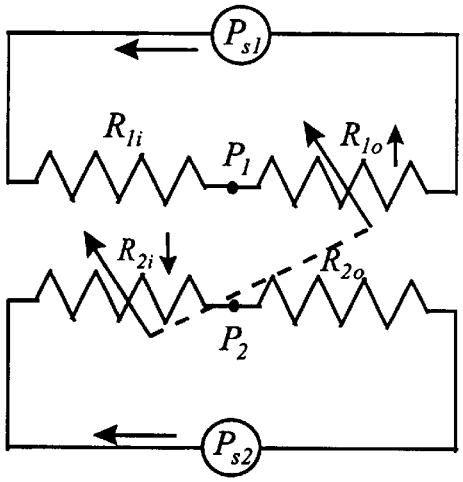
FIG. 46 is a schematic illustration of a circuit equivalent to a self-controlled bearing with two pressure supplies.

The same principle may apply to hydrostatic bearings with two pressure supplies as illustrated in FIG. 45. Here, the floating disk controls the inflow and outflow resistances. The equivalent circuit to the hydrostatic bearing with two pressure supplies is shown in FIG. 46.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A vacuum-hydrostatic shoe for supporting a workpiece comprising a workpiece holder with a support surface confrontable with said workpiece, said holder defining a vacuum pocket and a hydrostatic pocket, said vacuum pocket having a first vacuum opening defined in said support surface and a second vacuum opening fluidly connected to said first opening and fluidly connectable to a source of vacuum, said hydrostatic pocket having a first pressure opening defined in said support surface and a second pressure opening fluidly connected to said first opening and fluidly connectable to a source of pressurized fluid, wherein a fluid flow through said hydrostatic pocket generates a force on said workpiece away from said support surface and a vacuum flow through said vacuum pocket generates a force on said workpiece toward said support surface.

2. The vacuum-hydrostatic shoe of claim 1 wherein said holder defines a plurality of vacuum pockets and a plurality of hydrostatic pockets.

3. The vacuum-hydrostatic shoe of claim 1 wherein said holder defines one vacuum pocket and two hydrostatic pockets.

4. The vacuum-hydrostatic shoe of claim 1 wherein said workpiece is rotatable.

5. The vacuum-hydrostatic shoe of claim 1 wherein said workpiece support surface defines an arcuate surface for mating with a confronting workpiece surface.

6. The vacuum-hydrostatic shoe of claim 1 wherein said first openings define a width which is less than a width defined by said workpiece.

7. A vacuum-hydrostatic shoe for supporting a rotatable workpiece with a substantially circular surface in a shoe centerless grinder comprising:

a workpiece holder with an arcuate support surface for confronting said workpiece circular surface, said holder defining a vacuum pocket and first and second hydrostatic pockets therein, said vacuum pocket having a first vacuum opening defined in said support surface and a second vacuum opening fluidly connected to said first pressure opening and fluidly connectable to a source of vacuum, each said hydrostatic pocket having a first pressure opening defined in said support surface and a second pressure opening fluidly connected to said first opening and fluidly connectable to a source of pressurized fluid, wherein a fluid flow through said hydrostatic pockets generates a force on said workpiece away from said support surface and a vacuum flow through said vacuum pocket generates a force on said workpiece toward said support surface.

8. The vacuum-hydrostatic shoe of claim 7 wherein said arcuate support surface includes a leading end and a trailing end, said hydrostatic pockets are spaced between said leading and trailing edges and said vacuum pocket is located between said hydrostatic pockets.

9. A method of supporting a rotatable workpiece having a circular surface comprising:

providing a vacuum-hydrostatic shoe with a support surface for confronting said circular workpiece surface;

creating a source of vacuum between said vacuum-hydrostatic shoe and said circular workpiece surface;

creating a flow of pressurized fluid between said vacuum-hydrostatic shoe and said circular workpiece surface; and wherein a separation distance between said circular workpiece surface and said support surface is created by said flow of fluid and said source of vacuum.

10. The method of claim 9 comprising the step of regulating said flow of pressurized fluid to control said separation distance.

* * * * *